US008554123B2

(12) United States Patent
Motoki

(10) Patent No.: US 8,554,123 B2
(45) Date of Patent: Oct. 8, 2013

(54) FIXING DEVICE AND IMAGE FORMING APPARATUS INCLUDING THE SAME

(75) Inventor: Moriguchi Motoki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 256 days.

(21) Appl. No.: 13/187,189

(22) Filed: Jul. 20, 2011

(65) Prior Publication Data

US 2012/0020710 A1 Jan. 26, 2012

(30) Foreign Application Priority Data

Jul. 21, 2010 (JP) ..... 2010-164038
Jun. 16, 2011 (JP) ..... 2011-134182

(51) Int. Cl.
*G03G 15/20* (2006.01)

(52) U.S. Cl.
USPC ..... 399/334; 219/216; 219/643

(58) Field of Classification Search
USPC ..... 399/45, 67, 334; 219/216, 643, 219/635
See application file for complete search history.

(56) References Cited

U.S. PATENT DOCUMENTS 8,326,199 B2 * 12/2012 Koshida et al. ..... 399/328
2010/0028061 A1 2/2010 Nanjo et al.
2013/0034361 A1 * 2/2013 Shinagawa ..... 399/67

FOREIGN PATENT DOCUMENTS

JP 2010-032910 2/2010

* cited by examiner

*Primary Examiner* — Clayton E Laballe
*Assistant Examiner* — Michael Harrison
(74) *Attorney, Agent, or Firm* — Frommer Lawrence & Haug LLP

(57) ABSTRACT

A fixing device includes a heating rotating member that generates heat by induction heating; an induction coil that generates magnetic flux for induction heating; and a magnetic member core section forming a magnetic path and including a first core section, a second core section, a magnetic flux shielding member, and third core sections. The magnetic flux shielding member is disposed at a side of an end portion of the first core section opposite to the second core section and separated from the end portion, and disposed at a position that is separated from the outer surface of the heating rotating member by a separation distance. The third core sections are disposed at a side of the magnetic flux shielding member facing the end portion of the first core section. At least one of the third core sections is movable to a first position and to a second position.

18 Claims, 11 Drawing Sheets

FIXING DEVICE AND IMAGE FORMING APPARATUS INCLUDING THE SAME

INCORPORATION BY REFERENCE

This application is based upon and claims the benefit of priority from the corresponding Japanese Patent application No. 2010-164038, filed Jul. 21, 2010, and Japanese Patent application No. 2011-134182, filed Jun. 16, 2011, the entire contents of which are incorporated herein by reference.

FIELD

The present disclosure relates to a fixing device and an image forming apparatus including the fixing device.

BACKGROUND

Hitherto, image forming apparatuses, such as copying apparatuses, printers, facsimiles, and multi-functional peripherals of these apparatuses, have been known as being capable of forming (printing) an image on transfer materials, such as a sheet of paper. To fix an image to transfer material, the image forming apparatuses include fixing devices that have a heating rotating member, a pressing rotating member, and a heater, such as a halogen heater. The pressing rotating member and the heating rotating member form a fixing nip section for nipping the sheet of paper to which a toner image is transferred. The heater heats the heating rotating member.

In recent years, as a method of heating the heating rotating member in the fixing device, a method of heating the heating rotating member by induction heating (IH) that is achieved by electromagnetic induction may be used in addition to a method of heating the heating rotating member by using a halogen lamp. In the induction heating (IH), the fixing device includes a heating rotating member that generates heat by the induction heating, an induction coil that causes generation of magnetic flux for heating the heating rotating member by the induction heating, and a magnetic member core (magnetic member core section) that forms a magnetic path serving as a path for the magnetic flux generated by the induction coil. Comparing with the heating method of using a halogen lamp, the induction heating is advantageous in that it is capable of quick heating and provides high heating efficiency.

For the fixing device that uses the induction heating, various technologies are developed for suppressing an excessive temperature increase of the heating rotating member at an area (non-feeding area) that is situated outwardly of a feeding area where a sheet of paper passes. The suppression of the excessive temperature increase is conducted in accordance with a length (sheet feed width) in a paper-width direction of the sheet of paper that is transported (fed) to the fixing device. The sheet-width direction corresponds to a direction vertical to a direction of transportation of the sheet of paper. In particular, a fixing device is proposed to have the capability of adjusting the heating value of the heating rotating member at the non-feeding area and at the feeding area in the paper width direction in accordance with paper size.

The proposed fixing device includes a heating rotating member that generates heat by induction heating, a pressing rotating member that forms a fixing nip section with the heating rotating member, an induction coil that causes generation of magnetic flux, a magnetic member core (magnetic member core section) that forms a magnetic path serving as a path for magnetic flux generated by the induction coil, and a magnetic flux shielding member (magnetic member core section) that reduces or blocks the magnetic flux.

The magnetic member core of the proposed fixing device includes a center core (second core section), an arch core (first core section), and a side core (third core section). The center core forms a magnetic path near an inner peripheral edge of the induction coil, and has a surface opposing an outer peripheral surface of the heating rotating member without the induction coil being interposed therebetween. The arch core opposes the outer surface of the heating rotating member with the induction coil being interposed therebetween. The side core forms a magnetic path near an outer peripheral edge of the induction coil.

In the proposed fixing device, at the area that is situated outwardly of the feeding area where the sheet of paper passes, the magnetic flux shielding member is movable between a shielding position disposed between the center core and the heating rotating member and a non-shielding position that is not disposed between the center core and the heating rotating member. When the magnetic flux shielding member is positioned at the shielding position disposed between the center core and the heating rotating member, the magnetic flux shielding member opposes the outer peripheral surface of the heating rotating member, so that the magnetic flux is reduced or blocked. In such a fixing device, the center core and the arch core are disposed apart from each other by a distance that allows passage of the magnetic flux shielding member. The magnetic flux shielding member is movable between the center core and the heating rotating member.

Therefore, in the proposed fixing device, compared to when the center core and the arch core are integrated to each other or when the center core and the arch core are disposed in contact with or close to each other, the degree of coupling of a magnetic field between the center core and the arch core tends to weaken. Therefore, when the center core and the arch core are disposed apart from each other, heating efficiency of the heating rotating member is reduced compared to when the center core and the arch core are integrated to each other or when the center core and the arch core are disposed in contact with or close to each other.

Consequently, hitherto, in order to increase the heating value of the heating rotating member, the diameter of the induction coil is formed to a predetermined diameter. However, when the diameter of the induction coil remains the same as before, the heating rotating member needs to be large. As a consequence, the heat capacity of the heating rotating member is increased, and warm-up time may be increased, that is, the time from when the heating of the fixing device is started to when the fixing device becomes usable may be increased. Thus, there is a demand for a fixing device that can suppress a reduction in the heating efficiency of the heating rotating member.

SUMMARY

Some embodiments of the present disclosure relate to a fixing device that can suppress a reduction in the heating efficiency of a heating rotating member. The fixing device includes the heating rotating member that generates heat by induction heating using electromagnetic induction, an induction coil that causes generation of magnetic flux, and a magnetic member core section including a magnetic member core and a magnetic flux shielding member.

A fixing device according to an aspect of some embodiments of the present disclosure includes a heating rotating member configured to generate heat by induction heating; a pressing rotating member that is disposed so as to oppose the heating rotating member; a fixing nip section that is formed by the heating rotating member and the pressing rotating member, the fixing nip section nipping and transporting a transfer material; an induction coil disposed apart from and along an outer surface of the heating rotating member, the induction coil being operable for generating magnetic fluxes for causing the heating rotating member to generate the heat; and a magnetic member core section forming a magnetic path extending along an inner side of an inner peripheral edge of the induction coil and an outer side of an outer peripheral edge of the induction coil, the magnetic path surrounding the induction coil. The magnetic member core section includes a first core section, a second core section, a magnetic flux shielding member, and a plurality of third core sections. The first core section opposes the outer surface of the heating rotating member with the induction coil being disposed therebetween. The second core section is disposed beside the first core section and near the inner peripheral edge of the induction coil in a direction in which the magnetic path surrounds the induction coil. The second core section opposes the outer surface of the heating rotating member without the induction coil being disposed therebetween. The magnetic flux shielding member is disposed at a side of an end portion of the first core section opposite to the second core section and separated from the end portion near the outer peripheral edge of the induction coil. The magnetic flux shielding member opposes the outer surface of the heating rotating member without the induction coil being disposed therebetween. The magnetic flux shielding member reduces or blocks the magnetic flux. The plurality of third core sections are disposed at sides of the magnetic flux shielding member facing the end portion of the first core section. The plurality of third core sections oppose the outer surface of the heating rotating member without the induction coil being disposed therebetween. At least one of the third core sections is movable to a first position and to a second position. The first position is where an end portion of the at least one of the third core sections that faces the heating rotating member is separated from the outer surface of the heating rotating member by a first distance and opposes the outer surface of the heating rotating member. The second position is where the end portion of the at least one of the third core sections that faces the heating rotating member is separated from the outer surface of the heating rotating member by a second distance and opposes the outer surface of the heating rotating member. The second distance is greater than the first distance.

According to some embodiments, an image forming apparatus includes an image forming section configured to form a toner image on a transfer material, and a feed/discharge section configured to supply the transfer material to the image forming section and configured to discharge the transfer material on which the toner image is formed. The image forming section includes an image carrying member where an electrostatic latent image is formed, a developing device configured to develop the electrostatic latent image to form the toner image, a transfer device configured to transfer the toner image to the transfer material, and a fixing device configured to fix the toner image transferred to the transfer material to the transfer material. The fixing device includes a heating rotating member configured to generate heat by induction heating; a pressing rotating member that is disposed so as to oppose the heating rotating member; a fixing nip section that is formed by the heating rotating member and the pressing rotating member, the fixing nip section nipping and transporting a transfer material; an induction coil disposed apart from and along an outer surface of the heating rotating member, the induction coil being operable for generating magnetic fluxes for causing the heating rotating member to generate the heat; and a magnetic member core section forming a magnetic path extending along an inner side of an inner peripheral edge of the induction coil and an outer side of an outer peripheral edge of the induction coil, the magnetic path surrounding the induction coil. The magnetic member core section includes a first core section, a second core section, a magnetic flux shielding member, and a plurality of third core sections. The first core section opposes the outer surface of the heating rotating member with the induction coil being disposed therebetween. The second core section is disposed beside the first core section and near the inner peripheral edge of the induction coil in a direction in which the magnetic path surrounds the induction coil. The second core section opposes the outer surface of the heating rotating member without the induction coil being disposed therebetween. The magnetic flux shielding member is disposed at a side of an end portion of the first core section opposite to the second core section and separated from the end portion near the outer peripheral edge of the induction coil, the magnetic flux shielding member opposing the outer surface of the heating rotating member without the induction coil being disposed therebetween. The magnetic flux shielding member reduces or blocks the magnetic flux. The plurality of third core sections are disposed at sides of the magnetic flux shielding member facing the end portion of the first core section. The plurality of third core sections oppose the outer surface of the heating rotating member without the induction coil being disposed therebetween. At least one of the third core sections is movable to a first position and to a second position. The first position is where an end portion of the at least one of the third core sections that faces the heating rotating member is separated from the outer surface of the heating rotating member by a first distance and opposes the outer surface of the heating rotating member. The second position is where the end portion of the at least one of the third core sections that faces the heating rotating member is separated from the outer surface of the heating rotating member by a second distance and opposes the outer surface of the heating rotating member. The second distance is greater than the first distance.

According to yet other embodiments, a fixing device includes a heating rotating member configured to generate heat by electromagnetic induction, a pressing rotating member that opposes the heating rotating member, an induction coil operable to generate magnetic flux for causing the heating rotating member to generate the heat; and a magnetic member core section that surrounds the induction coil. The magnetic member core section includes a magnetic flux shielding member that reduces or blocks the magnetic flux and a plurality of movable core sections capable of being moved to predetermined positions. The plurality of movable core sections moves to the predetermined positions to allow the magnetic flux to be reduced or blocked by the magnetic flux shielding member.

The above and other objects, features, and advantages of various embodiments of the present disclosure will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include". The phrase "an embodiment" as used herein does not necessarily refer to the same embodiment, though it may. In addition, the meaning of "a," "an," and "the" include plural references; thus, for example, "an embodiment" is not limited to a single embodiment but refers to one or more embodiments. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise.

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present disclosure without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Figure 1:
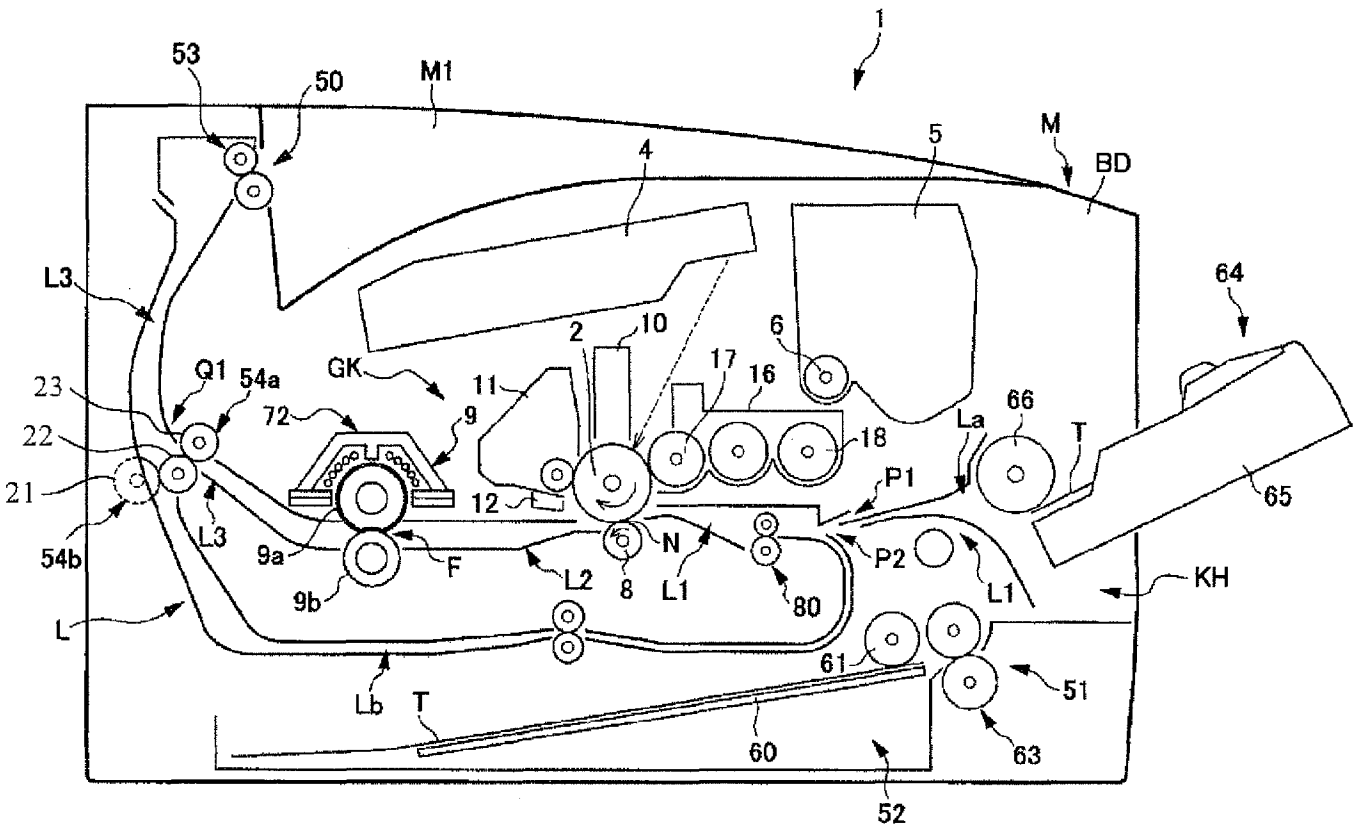
FIG. 1 illustrates an exemplary arrangement of structural elements of a printer according to some embodiments of the present disclosure.

An exemplary structure of a printer 1, serving as an image forming apparatus, according to some embodiments will be described with reference to FIG. 1. FIG. 1 illustrates an exemplary arrangement of structural elements of the printer 1 according to some embodiments of the present disclosure. In the description below, an up-down direction in FIG. 1 may be simply referred to as "vertical direction."

As shown in FIG. 1, the printer 1 according to some embodiments includes an apparatus main body M. The apparatus main body M includes an image forming section GK that forms a toner image on a transfer material, such as a sheet of paper T on the basis of image information, and a paper-feed/discharge section KH that feeds the sheet of paper T to the image forming section GK and discharges the sheet of paper T having the toner image formed thereon. Other transfer material that may be used includes plastics or fabric.

The outer shape of the apparatus main body M is defined by a case body BD serving as a housing.

As shown in FIG. 1, the image forming section GK includes a photosensitive drum 2 serving as an image carrying member (photosensitive member), a charging section 10, a laser scanner unit 4 serving as an exposure unit, a developing device 16, a toner cartridge 5, a toner supplying section 6, a drum cleaning section 11, a neutralization device 12, a transfer roller 8 serving as a transfer section, and a fixing device 9.

As shown in FIG. 1, the paper-feed/discharge section KH includes a paper-feed cassette 52, a manual paper-feed section 64, a transport path L of a sheet of paper T, a pair of registration rollers 80, and a paper-discharge section 50. The transport path L includes path La, Lb, L1, L2, and L3.

The structure of the image forming section GK and the structure of the paper-feed/discharge section KH will hereunder be described in detail.

First, the image forming section GK will be described. In the image forming section GK, from an upstream side to a downstream side along the surface of the photosensitive drum 2, a series of processing is performed including charging by the charging section 10, exposure by the laser scanner unit 4, development by the developing device 16, transfer by the transfer roller 8, removal of electricity by the neutralization device 12, and cleaning by the drum cleaning section 11.

The photosensitive drum 2 may be a cylindrical member, and functions as a photosensitive member or an image carrying member. The photosensitive drum 2 is disposed so as to be rotatable in the direction of an arrow shown in FIG. 1 around an axis of rotation extending in a direction vertical to a conveying direction of the sheet of paper T in the transport path L. An electrostatic latent image can be formed on the surface of the photosensitive drum 2.

The charging section 10 is disposed so as to oppose the surface of the photosensitive drum 2. The charging section 10 uniformly negatively or positively charges the surface of the photosensitive drum 2 (that is, uniformly charges it to a negative polarity or a positive polarity).

The laser scanner unit 4 functions as an exposure unit, and is disposed apart from the surface of the photosensitive drum 2. The laser scanner unit 4 includes, for example, a laser light source, a polygon mirror, and a polygon mirror driving motor (not shown).

The laser scanner unit 4 performs scanning and exposure on the surface of the photosensitive drum 2 on the basis of image information input from an external apparatus such as a personal computer (PC). When the laser scanner unit 4 performs the scanning and exposure, electric charge provided at an exposed portion of the surface of the photosensitive drum 2 is removed. This causes an electrostatic latent image to be formed on the surface of the photosensitive drum 2.

The developing device 16 is disposed so as to oppose the surface of the photosensitive drum 2. The developing device 16 develops the electrostatic latent image formed on the photosensitive drum 2 by using monochromatic toner (ordinarily, black toner), to form a monochromatic toner image on the surface of the photosensitive drum 2. The developing device 16 includes, for example, a development roller 17, disposed so as to oppose the surface of the photosensitive drum 2, and a stirring roller 18 for stirring the toner.

The toner cartridge 5 is provided in correspondence with the developing device 16, and contains toner that is supplied to the developing device 16.

The toner supplying section 6 is provided in correspondence with the toner cartridge 5 and the developing device 16, and supplies the toner contained in the toner cartridge 5 to the developing device 16. The toner supplying section 6 and the developing device 16 are connected to each other by a toner supply path (not shown).

The transfer roller 8 transfers the toner image developed on the surface of the photosensitive drum 2 to the sheet of paper T. A transfer bias applying section (not shown) applies to the transfer roller 8 a transfer bias for transferring the toner image formed on the photosensitive drum 2 to the sheet of paper T. The transfer roller 8 is rotatable while in contact with the photosensitive drum 2.

The sheet of paper T that is transported along the transport path L is nipped between the photosensitive drum 2 and the transfer roller 8. The nipped sheet of paper T is pushed against the surface of the photosensitive drum 2. A transfer nip section N is formed between the photosensitive drum 2 and the transfer roller 8. At the transfer nip section N, the toner image developed on the photosensitive drum 2 is transferred to the sheet of paper T.

The neutralization device 12 is disposed so as to oppose the surface of the photosensitive drum 2. By irradiating the surface of the photosensitive drum 2 with light, the neutralization device 12 removes electricity (electric charge) from the surface of the photosensitive drum 2 after the transfer.

The drum cleaning section 11 is disposed so as to oppose the surface of the photosensitive drum 2. The drum cleaning section 11 removes extraneous matter and toner remaining on the surface of the photosensitive drum 2 and transports the removed toner and so on to a collecting mechanism (not shown) for collecting the removed toner and so on.

The fixing device 9 fuses and presses the toner of the toner image transferred to the sheet of paper T, to fix the toner image to the sheet of paper T. The fixing device 9 includes a heating rotating member 9*a* that generates heat by induction heating using electromagnetic induction, and a pressing rotating member 9*b* that press-contacts the heating rotating member 9*a*. The heating rotating member 9*a* and the pressing rotating member 9*b* heat and press the sheet of paper T to which the toner image has been transferred by nipping this sheet of paper T while transporting this sheet of paper T. This fuses and presses the toner transferred to the sheet of paper T, so that the toner is fixed to the sheet of paper T. The details of the fixing device 9 will be described in detail later.

Next, the paper-feed/discharge section KB will be described.

As shown in FIG. 1, the paper-feed cassette 52 that accommodates sheets of paper T is disposed at a lower portion of the apparatus main body M. The paper-feed cassette 52 is capable of being drawn out horizontally from the right side (in FIG. 1) of the apparatus main body M. A plate 60 on which the sheets of paper T are stacked is disposed at the paper-feed cassette 52. The sheets of paper T placed on the plate 60 are sent out to the transport path L by a cassette paper-feed section 51 disposed at an end portion at a paper send-out side (that is, a right end portion in FIG. 1) of the paper-feed cassette 52. The cassette paper-feed section 51 includes a forward-feed roller 61 and a double-feed prevention mechanism. The forward-feed roller 61 is used for taking out the sheets of paper T on the plate 60. The double-feed prevention mechanism includes a pair of paper-feed rollers 63 for sending out the sheets of paper T one at a time to the transport path L.

The manual paper-feed section 64 is provided at the right side (in FIG. 1) of the apparatus main body M. The manual paper-feed section 64 is provided primarily for the purpose of supplying to the apparatus main body M sheets of paper T differing in size and type from the sheets of paper T accommodated in the paper-feed cassette 52. The manual paper-feed section 64 includes a manual tray 65 forming a portion of the front surface of the apparatus main body M when the manual tray 65 is closed, and a paper-feed roller 66. A lower end of the manual tray 65 is rotatably mounted to a portion of the apparatus main body M near the paper-feed roller 66 so as to be openable and closable. The sheets of paper T are placed on the manual tray 65 in an open state. The paper-feed roller 66 feeds to the transport path L the sheets of paper T placed on the manual tray 65 in the open state.

The paper-discharge section 50 is provided at an upper side of the apparatus main body M. The paper-discharge section 50 discharges the sheets of paper T to the outside of the apparatus main body M by using a pair of third rollers 53. The paper-discharge section 50 will be described in detail later.

The transport path L for transporting the sheets of paper T includes a first transport path L1 extending from the cassette paper-feed section 51 to the transfer nip section N, a second transport path L2 extending from the transfer nip section N to the fixing device 9, a third transport path L3 extending from the fixing device 9 to the paper-discharge section 50, a manual transport path La that allows the sheets of paper T supplied from the manual paper-feed section 64 to be transported to the first transport path L1, and a return transport path Lb that returns the sheets of paper T transported from a downstream side to an upstream side of the third transport path L3 to the first transport path L1 by reversing the front and back of these sheets of paper T.

A first merging portion P1 and a second merging portion P2 are provided in the first transport path L1. A first branch portion Q1 is provided in the third transport path L3. The first merging portion P1 is where the manual transport path La merges with the first transport path L1. The second merging portion P2 is where the return transport path Lb merges with the first transport path L1. The first branch portion Q1 is where the return transport path Lb is branched from the third transport path L3, and is provided with a pair of first rollers 54*a* including a roller 22 and a roller 23 and a pair of second rollers 54*b* including the roller 22 and a roller 21. One of the pair of first rollers 54*a* and one of the pair of second rollers 54*b* are used in common, such as the roller 22.

A sensor (not shown) for detecting the sheets of paper T and the pair of registration rollers 80 are disposed in the first transport path L1 (more specifically, between the second merging portion P2 and the transfer nip section N). The pair of registration rollers 80 is provided for performing skew (oblique paper-feed) correction of the sheets of paper T and adjusting a timing of the formation of a toner image at the image forming section GK with a timing of the transportation of the sheet of paper T. The sensor is disposed just before the pair of registration rollers 80 in the conveying direction of the sheet of paper T (that is, at an upstream side in the conveying direction of the sheet of paper T). On the basis of information regarding a detection signal from the sensor, the pair of registration rollers 80 performs the aforementioned correction and adjusts the timing.

The return transport path Lb is provided for causing a surface of a sheet of paper T that is opposite to a surface of the sheet of paper T on which printing has been performed (that is, an unprinted surface of the sheet of paper T) to oppose the photosensitive drum 2 when performing two-side printing on the sheet of paper T. The return transport path Lb allows the sheet of paper T that has been transported from the first branch portion Q1 towards the paper-discharge section 50 by the pair of first rollers 54*a* to have its front and back reversed, to be returned to the first transport path L1 by the pair of second rollers 54*b*, and to be transported to an upstream side of the pair of registration rollers 80 disposed upstream from the transfer roller 8 in the conveying direction of the sheet of paper T. At the transfer nip section N, the toner image is transferred to the unprinted surface of the sheet of paper T whose front and back have been reversed in the return transport path Lb.

The paper-discharge section 50 is provided at an end portion of the third transport path L3. The paper-discharge section 50 is disposed at an upper portion of the apparatus main body M. The paper-discharge section 50 opens towards the right of the apparatus main body M (that is, the right side or a manual paper-feed section 64 side). The paper-discharge section 50 discharges the sheets of paper T that are transported through the third transport path L3 to the outside of the apparatus main body M by the pair of third rollers 53.

A paper-discharge piling section M1 is provided at the open side of the paper-discharge section 50. The paper-discharge piling section M1 is provided an upper surface (outer surface) of the apparatus main body M. The paper-discharge piling section M1 corresponds to a portion of the upper surface of the apparatus main body M that is depressed downward. A bottom surface of the paper-discharge piling section M1 constitutes a portion of the upper surface of the apparatus main body M. The sheets of paper T having the toner images formed thereon and discharged from the paper-discharge section 50 are piled in layers on the paper-discharge piling section M1. A sensor (not shown) for detecting sheets of paper T is disposed at a suitable position in each transport path.

Figure 2A:
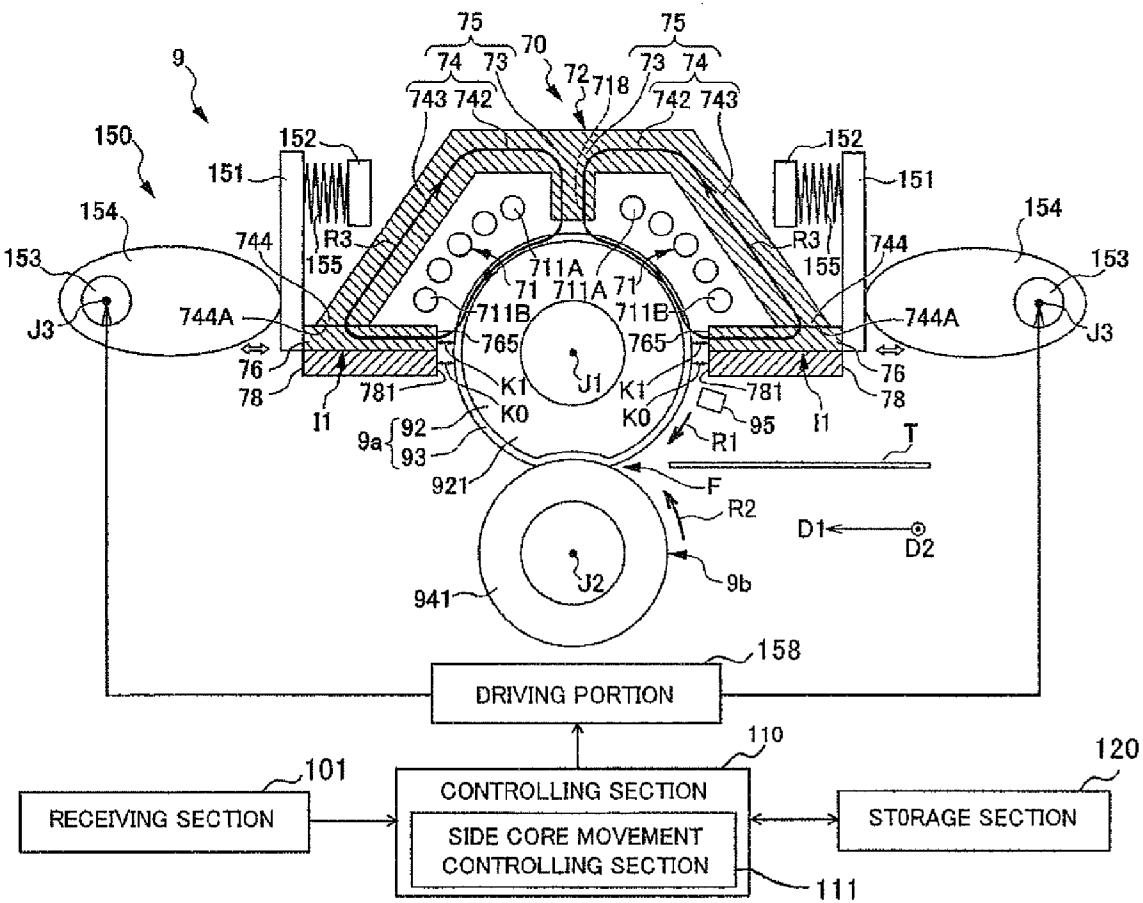
FIG. 2A is an exemplary sectional view for illustrating structural elements of a fixing device of the printer according to some embodiments when side cores are positioned at first positions.
Figure 2B:
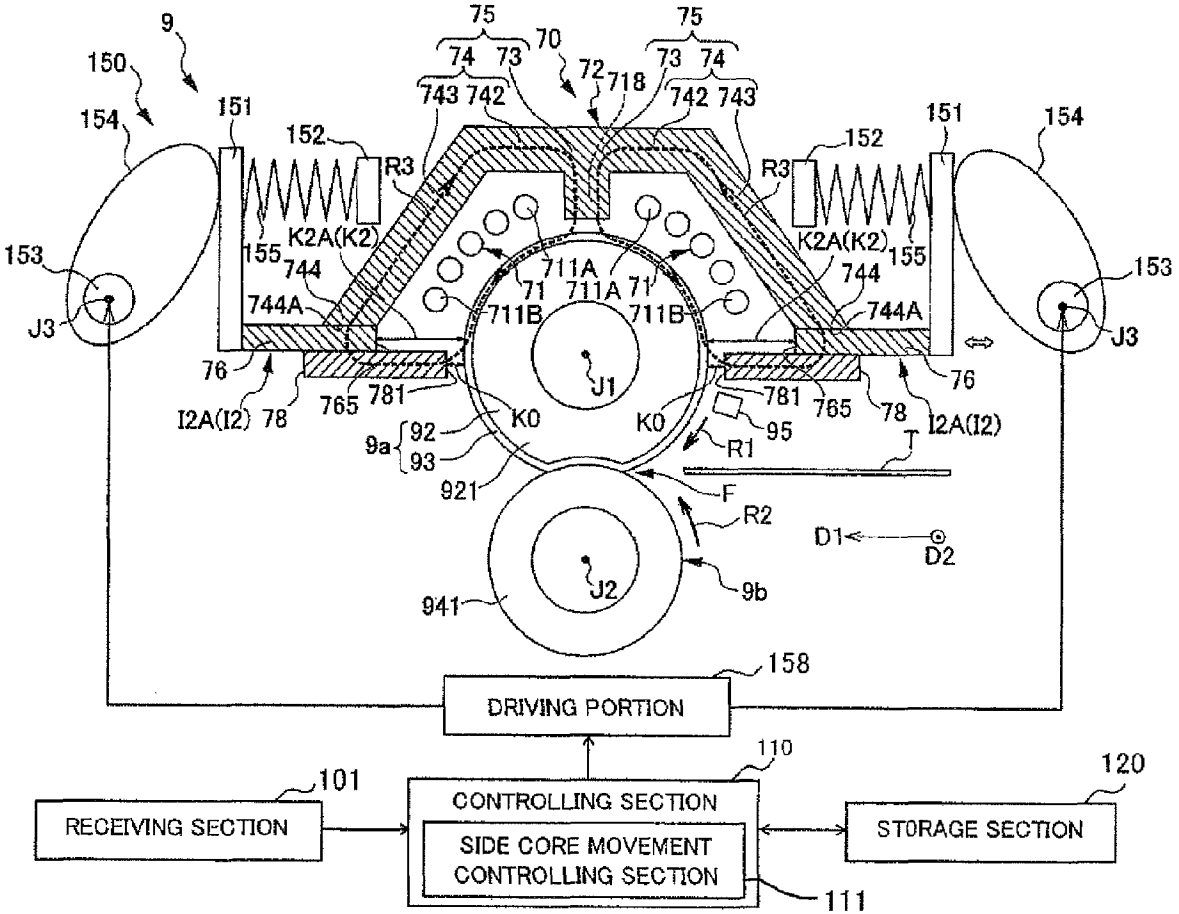
FIG. 2B is an exemplary sectional view for illustrating structural elements of the fixing device of the printer according to some embodiments when the side cores are positioned at 2A positions.
Figure 2C:
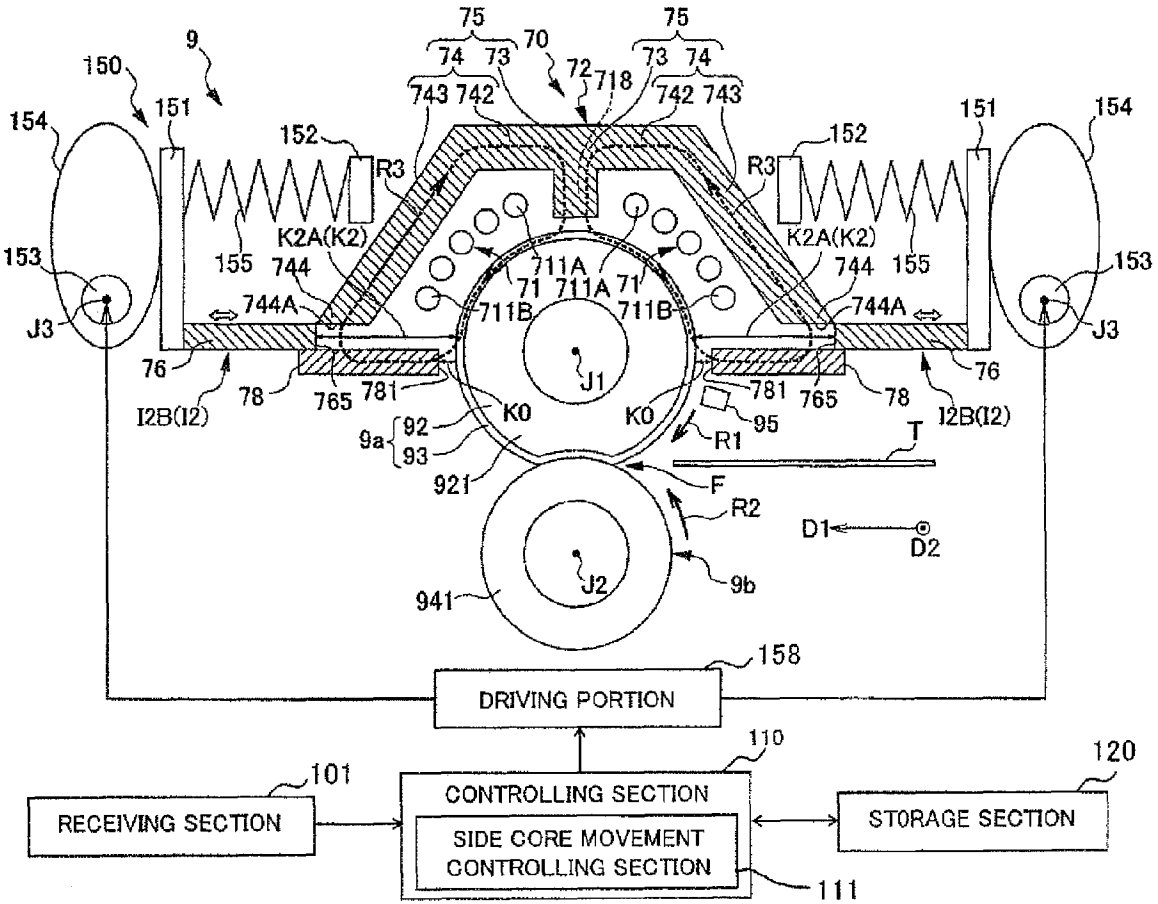
FIG. 2C is an exemplary view for illustrating structural elements of the fixing device of the printer according to some embodiments when the side cores are positioned at 2B positions.
Figure 3:
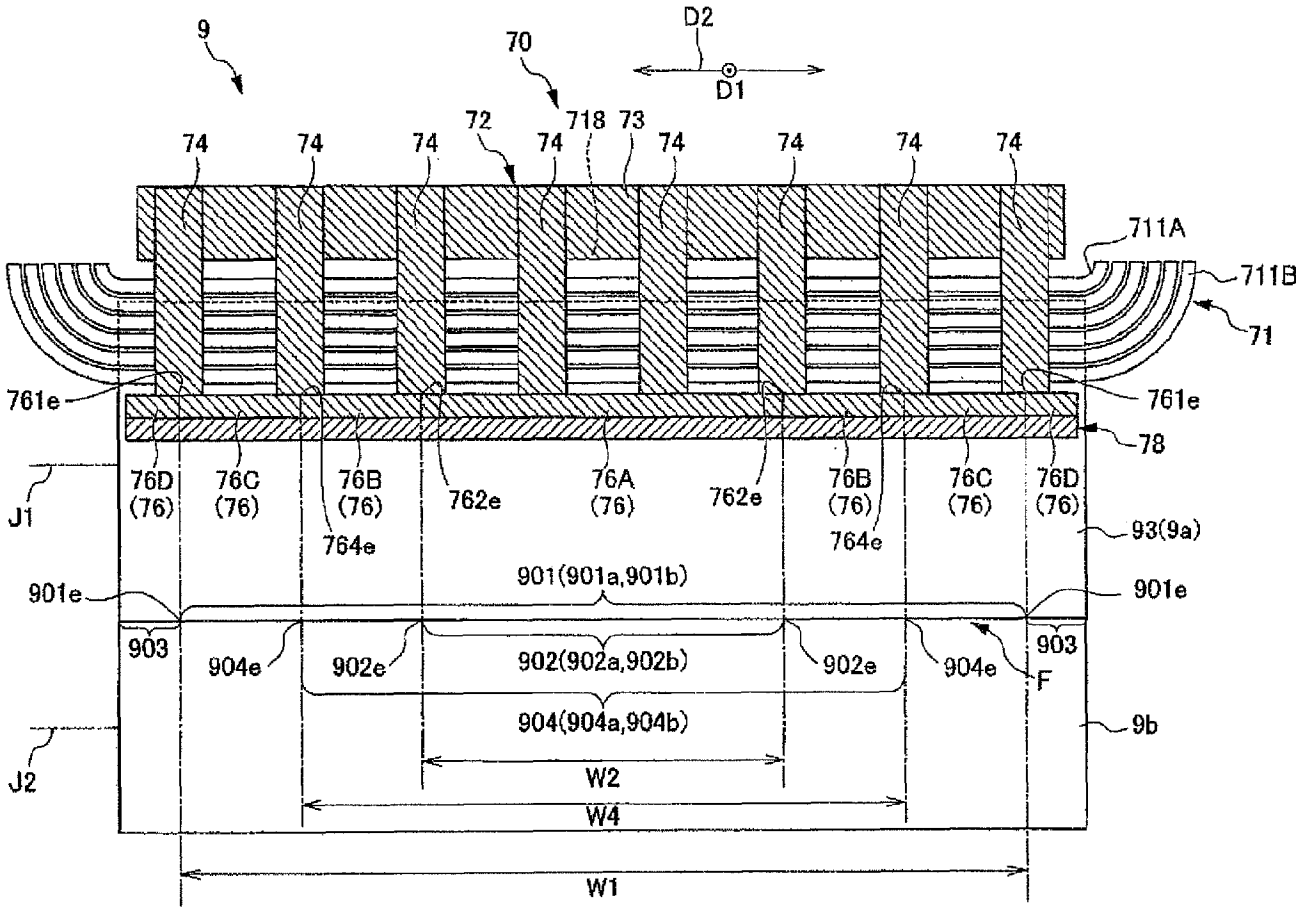
FIG. 3 shows the fixing device shown in FIGS. 2A, 2B, and 2C when viewed from a direction of transportation of a sheet of paper.
Figure 4A:
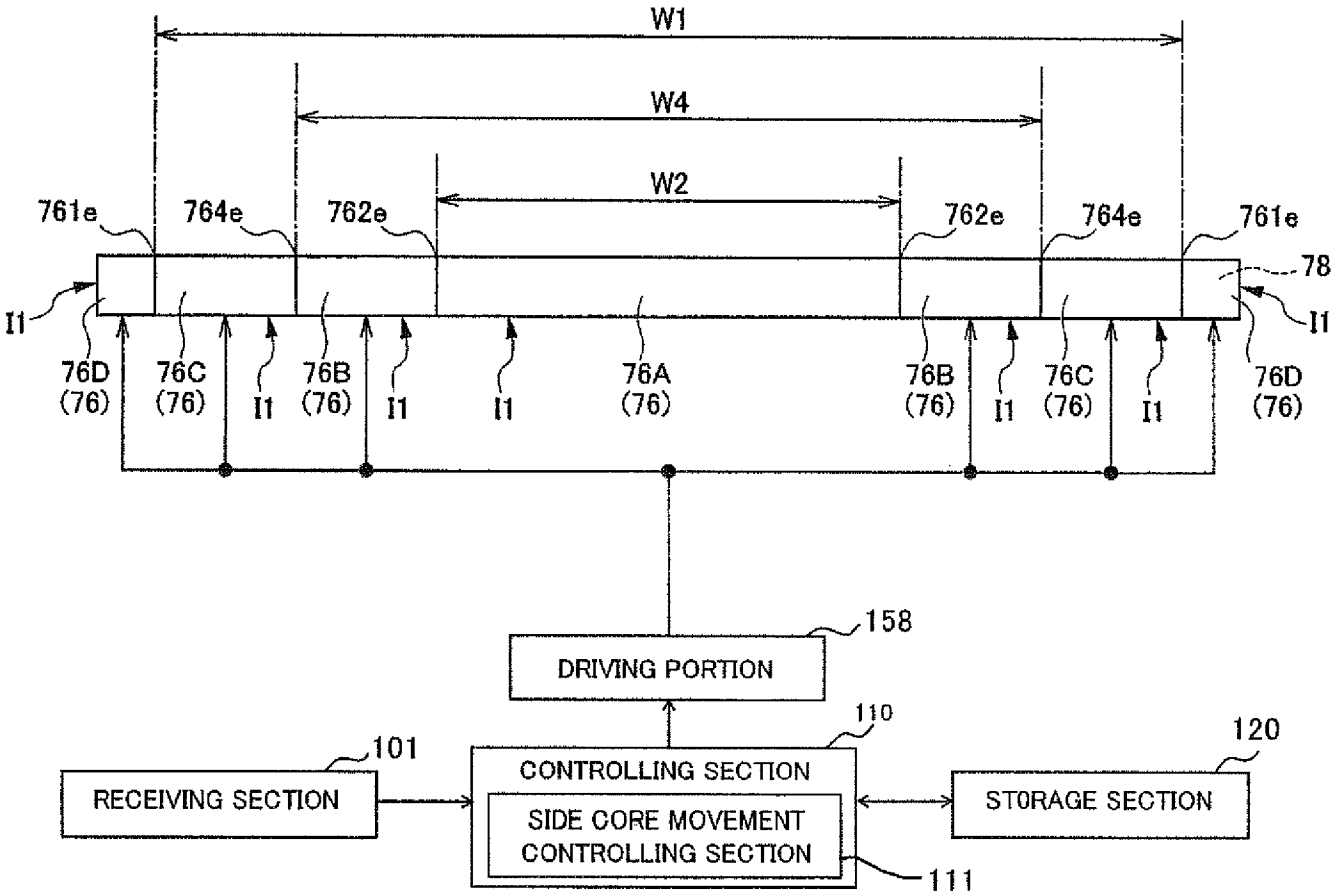
FIG. 4A shows exemplary positional relationships between the side cores and a pair of first magnetic flux shielding members of the printer according to some embodiments from an upper side in a vertical direction, with the side cores being positioned at the first positions.
Figure 4B:
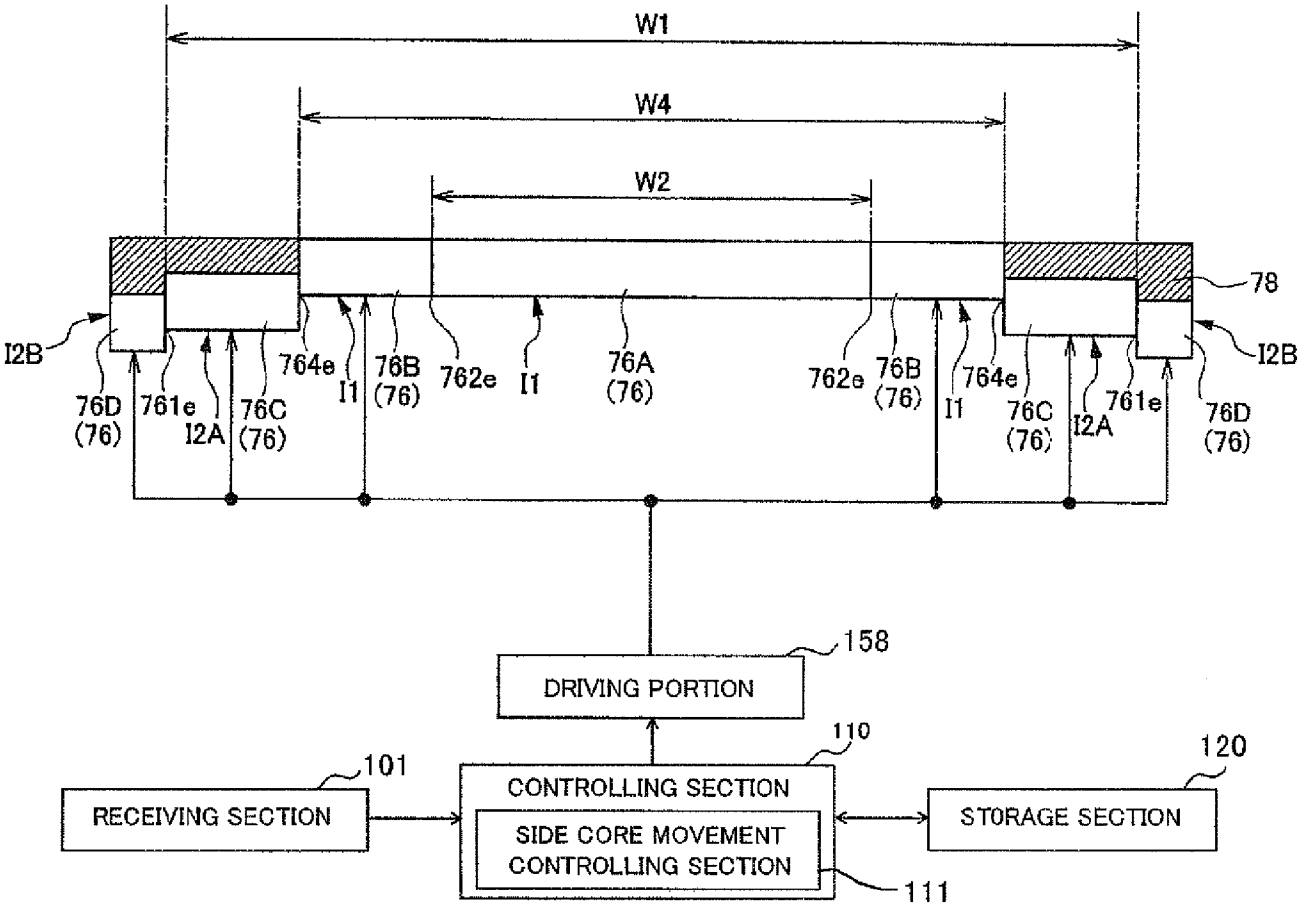
FIG. 4B shows exemplary positional relationships between the side cores and the pair of first magnetic flux shielding members of the printer according to some embodiments from the upper side in the vertical direction, with the side cores being positioned at the 2A positions.
Figure 4C:
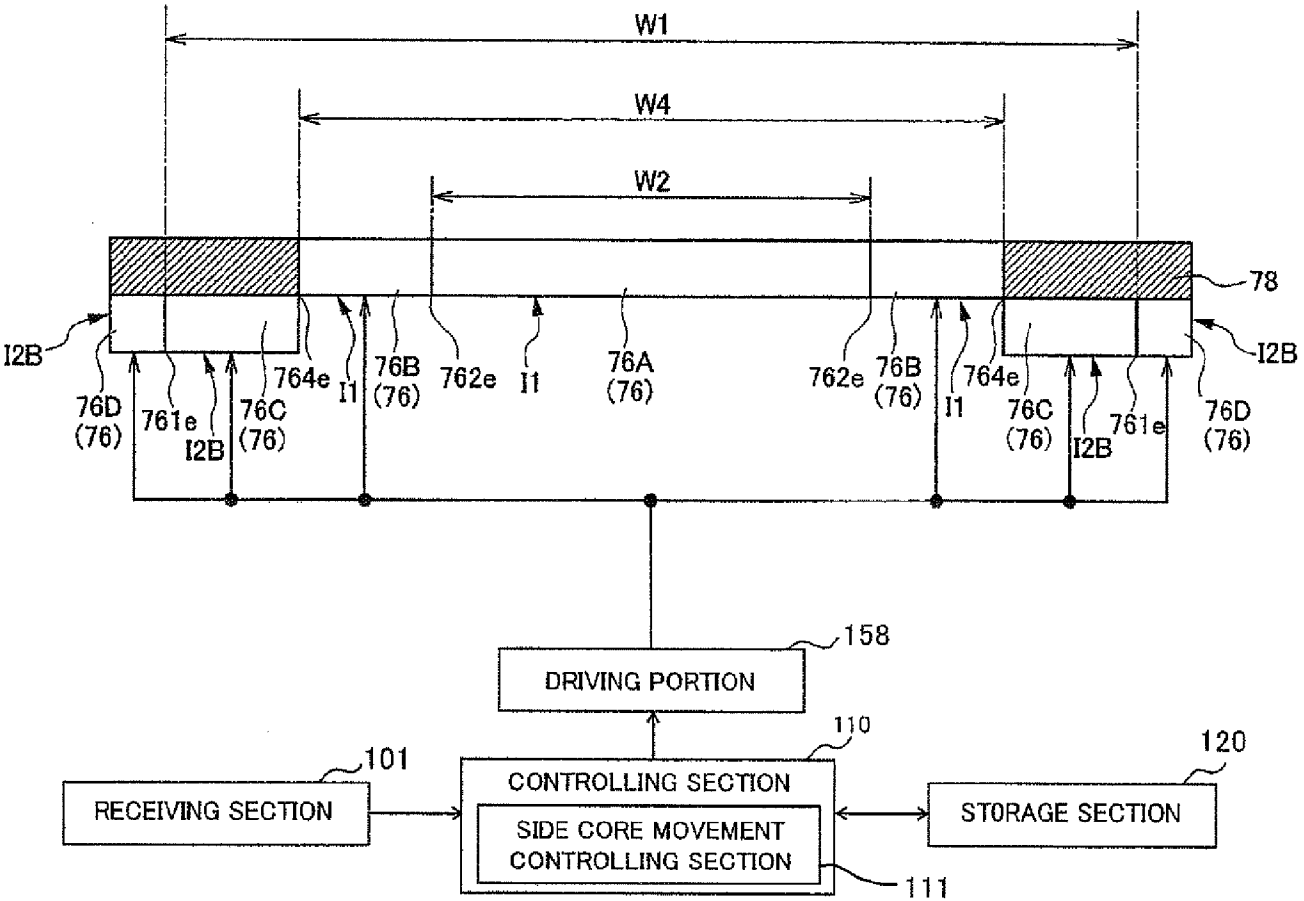
FIG. 4C shows exemplary positional relationships between the side cores and the pair of first magnetic flux shielding members of the printer according to some embodiments from the upper side in the vertical direction, with the side cores being positioned at the 2B positions.

Next, the structure of the fixing device 9 of the printer 1 according to some embodiments will be described in detail. FIGS. 2A to 2C are exemplary sectional views for illustrating structural elements of the fixing device 9 of the printer 1 according to some embodiments. FIG. 2A is an exemplary sectional view in the case when side cores 76 are positioned at first positions I1. FIG. 2B is an exemplary sectional view in the case when the side cores 76 are positioned at 2A positions I2A. FIG. 2C is an exemplary sectional view in the case when the side cores 76 are positioned at 2B positions I2B. FIG. 3 shows the fixing device 9 shown in FIGS. 2A, 2B, and 2C when viewed from the conveying direction of the sheet of paper T, D1. FIGS. 4A to 4C each show exemplary positional relationships between the side cores 76 and a pair of first magnetic flux shielding members 78 of the printer 1 according to some embodiments from an upper side in the vertical direction. FIG. 4A shows a case when the side cores 76 are positioned at the first positions I1. FIG. 4B shows a case when the side cores 76 are positioned at the 2A positions I2A. FIG. 4C shows a case when the side cores 76 are positioned at the 2B positions I2B.

As shown in FIGS. 2A to 2C, the fixing device 9 includes the heating rotating member 9*a*, the pressing rotating member 9*b* press-contacting (or contacting) the heating rotating member 9*a*, a heating unit 70, and a plurality of temperature sensors 95.

The heating rotating member 9*a* may have an annular shape. The annular heating rotating member 9*a* may also include a cylindrical heating rotating member 9*a*. The heating rotating member 9*a* is rotatable in a first circumferential direction R1. Although described in detail below, by using the heating unit 70 (described below), the heating rotating member 9*a* generates heat by induction heating (1H) using electromagnetic induction.

The heating rotating member 9*a* includes a fixing-side roller 92 and a heating rotating belt 93 disposed so as to cover an outer peripheral surface of the fixing-side roller 92.

The fixing-side roller 92 will be described. The fixing-side roller 92 may be cylindrical. The fixing-side roller 92 is rotatable in the first circumferential direction R1 around a first rotation axis J1 extending in a direction D2 that is vertical to the first circumferential direction R1. The fixing-side roller 92 extends in the direction of the first rotation axis J1. The vertical direction D2 that is vertical to the first circumferential direction R1 also corresponds to a direction that is vertical to the transportation direction D1 of the sheet of paper T. In the embodiment, the vertical direction D2 that is vertical to the first circumferential direction R1 is also referred to as "paper width direction D2."

The fixing-side roller 92 includes a fixing-side roller body 921 and axial members (not shown) that is coaxial with the first rotation axis J1. The fixing-side roller body 921 includes a cylindrical metallic member and an elastic layer formed on the outer peripheral surface of the metallic member. Heat that has generated by induction heating in the heating rotating belt 93 can be transmitted to the fixing-side roller 92.

According to some embodiments, the fixing-side roller body 921 is formed by, for example, providing an elastic layer on an outer peripheral surface of a metallic tube. The elastic layer is formed of, for example, silicone sponge rubber having a thickness of approximately 9 mm. The metallic tube is formed of a nonmagnetic material, such as aluminum or stainless steel (SUS), having a diameter of approximately 27 mm and a thickness of 2 mm.

The axial members (not shown) of the fixing-side roller 92 protrude outwardly from both end portions of the fixing-side roller body 921 in the direction of the first rotation axis J1. The axial members of the fixing-side roller 92 are rotatably supported by, for example, a case of the fixing device 9. This makes the fixing-side roller 92 rotatable around the first rotation axis J1.

The heating rotating belt 93 will be described. The heating rotating belt 93 may be an annular (endless) belt. The heating rotating belt 93 is rotatable in the first circumferential direction R1, and is disposed around the outer peripheral surface of the fixing-side roller 92 so as to cover the outer peripheral surface of the fixing-side roller 92. The outer peripheral surface of the fixing-side roller 92 contacts an inner peripheral surface of the heating rotating belt 93. The heating rotating belt 93 is heat-resistant.

According to some embodiments, a base of the heating rotating belt 93 is formed of a ferromagnetic material, such as nickel. The heating rotating belt 93 is formed by providing a silicone rubber elastic layer having a thickness of approximately 0.3 mm on an outer peripheral surface of a metallic belt formed of nickel (ferromagnetic material) having a thickness of approximately 35 μm, and by providing a release layer on an outer peripheral surface of the elastic layer. The release layer is formed of a heat-resistant film formed of fluorocarbon resin (such as tetrafluoroethylene-perfluoroalkyl vinyl ether copolymer (PFA) or polytetrafluoroethylene (PTFE)) having a thickness of approximately 30 μm.

Since the base of the heating rotating belt 93 is formed of ferromagnetic material, the heating rotating belt 93 forms magnetic paths for magnetic fluxes that are generated by induction coil 71. The magnetic permeability of the base of the heating rotating belt 93 formed of ferromagnetic material is selected to be higher than the magnetic permeability of the fixing-side roller 92 whose main body is formed of a non-magnetic material and the magnetic permeability of surrounding air. The magnetic fluxes that are generated by the induction coil 71 passes (is guided) along the heating rotating belt 93 that forms the magnetic paths.

The heating rotating belt 93 generates eddy current (induced current) by electromagnetic induction resulting from the magnetic fluxes generated by the induction coil 71 and passing through the heating rotating belt 93. When the eddy current flows through the heating rotating belt 93, the heating rotating belt 93 generates Joule heat by electric resistance of the heating rotating belt 93. In this way, by using the heating unit 70 (described later), the heating rotating belt 93 generates heat by induction heating (IH) using electromagnetic induction.

The pressing rotating member 9*b* will be described. The pressing rotating member 9*b* may have an annular shape. The annular pressing rotating member 9*h* may also include a cylindrical pressing rotating member 9*b*. The pressing rotating member 9*b* is rotatable in a second circumferential direction R2, and forms a fixing nip section F together with the heating rotating member 9*a*. The fixing nip section F nips and transports a sheet of paper T.

According to some embodiments, the pressing rotating member 9*b* may be cylindrical, and is disposed so as to oppose the fixing-side roller 92 below the heating rotating member 9*a* in the vertical direction. The pressing rotating member 9*b* is rotatable in the second circumferential direction R2 around a second rotation axis J2 extending in the paper width direction D2. The pressing rotating member 9*b* extends in the direction of the second rotation axis J2.

The pressing rotating member 9*b* is disposed so that its outer peripheral surface contacts an outer peripheral surface (outer surface) of the heating rotating belt 93. More specifically, the pressing rotating member 9*b* is disposed so as to press the fixing-side roller 92 through the heating rotating belt 93. The pressing rotating member 9*b* forms the fixing nip section F together with the heating rotating belt 93 by nipping a portion of the heating rotating belt 93 along with the fixing-side roller 92.

The pressing rotating member 9*b* includes a pressing rotating member body 941 and axial members (not shown) that are coaxial with the second rotation axis J2. The pressing rotating member body 941 includes a cylindrical metallic member, an elastic layer formed on an outer peripheral surface of the metallic member, and a release layer formed on an outer peripheral surface of the elastic layer.

According to some embodiments, the pressing rotating member 9*b* is formed by, for example, providing an elastic layer on an outer peripheral surface of a metallic tube, and providing a release layer on a surface of the elastic layer. The elastic layer is formed of, for example, silicone rubber having a thickness of approximately 2 mm. The metallic tube is formed of, for example, aluminum or stainless steel (SUS) having a diameter of approximately 46 mm. The release layer is formed of fluorocarbon resin, such as PFA or PTFE, having a thickness of approximately 50 μm.

The axial members (not shown) of the pressing rotating member 9*b* protrude outwardly from both end portions of the pressing rotating member body 941 in the direction of the second rotation axis J2. The axial members of the pressing rotating member 9*b* are supported by, for example, the case of the fixing device 9 so as to be rotatable around the second rotation axis J2.

A rotation driving section (not shown) that rotationally drives the pressing rotating member 9*b* is connected to one of the axial members of the pressing rotating member 9*b*. The rotation driving section causes the pressing rotating member 9*b* to be rotationally driven at a predetermined velocity in the second circumferential direction R2. By being driven by the rotation of the pressing rotating member 9*b*, the heating rotating belt 93 that contacts an outer peripheral surface of the pressing rotating member 9*b* is rotated in the first circumferential direction R1. By rotating the heating rotating belt 93, the fixing-side roller 92 that contacts the inner peripheral surface of the heating rotating belt 93 is rotated by being driven by the rotation of the heating rotating belt 93.

When a sheet of paper T transported to the fixing nip section F passes and is transported into a paper-feeding area of the fixing device 9, a toner image is fixed to the sheet of paper T. Here, the term "paper-feeding area" refers to an area in the paper width direction D2 (that is vertical to the transportation direction D1 of the sheet of Paper T) where the sheet of paper T that is transported to the fixing nip section F is nipped by and passes between the heating rotating belt 93 and the pressing rotating member 9*b*. With the center of the heating rotating member 9*a* and the pressing rotating member 9*b* in the paper width direction D2 serving as a reference, the paper-feeding area is formed (set) in accordance with a maximum size (a maximum width) of a sheet of paper T that is usable in the printer 1.

Although described in detail below, by setting paper-feeding areas for respective transportations of sheets of paper T having different lengths in the paper width direction D2 to the fixing nip section F, the fixing device 9 according to some embodiments of the disclosure is capable of suppressing an excessive temperature increase of the heating rotating belt 93 at areas outside the paper-feeding areas corresponding to the respective sizes of the sheets of paper T.

As shown in FIG. 3, in the fixing device 9 according to some embodiments, a maximum paper-feeding area 901 is set as a paper-feeding area used when sheets of paper T having the maximum length (the maximum width) in the paper width direction D2 are transported to the fixing nip section F. The maximum paper-feeding area 901 is formed (set) at the outer peripheral surface of the heating rotating belt 93 and the outer peripheral surface of the pressing rotating member 9*b*. The maximum paper-feeding area 901 is set for every printer 1. The maximum paper-feeding area is capable of accepting at least an A3-size sheet of paper T when the A3 size sheet of paper T is transported to the fixing nip section F with a short side of the A3-size sheet of paper T being parallel to the paper width direction D2 (the sheet of paper T being an A3 portrait size sheet of paper).

More specifically, as shown in FIG. 3, a heating-side maximum paper-feeding area 901*a* is formed (set) as the maximum paper-feeding area 901 of the heating rotating member 9*a* at the outer peripheral surface of the heating rotating belt 93. For example, as shown in FIG. 3, the heating-side maximum paper-feeding area 901*a* (maximum paper-feeding area 901) that an A3 portrait size sheet of paper T (serving as a sheet of paper T having the maximum length in the paper width direction D2) contacts and passes when the sheet of paper T is transported to the fixing nip section F is formed at the outer peripheral surface of the heating rotating belt 93.

A pressing-side maximum paper-feeding area 901*b* serving as the maximum paper-feeding area 901 of the pressing rotating member 9*b* is formed (set) at the outer peripheral surface of the pressing rotating member 9*b* in correspondence with the heating-side maximum paper-feeding area 901*a* of the heating rotating belt 93. For example, the pressing-side maximum paper-feeding area 901*b* (maximum feeding area 901) that an A3 portrait size sheet of paper T contacts and passes when this sheet of paper T is transported to the fixing nip section F is formed (set) at the outer peripheral surface of the pressing rotating member 9*b*.

The positions corresponding to outer edges of the sheet of paper T having the maximum length (maximum width) in the paper width direction D2 when this sheet of paper T passes the heating-side maximum paper-feeding area 901*a* become heating-side maximum area outer edges 901*e* serving as outer edges of the heating-side maximum paper-feeding area 901*a*. That is, the sheet of paper T having the maximum length is transported in the heating-side maximum paper-feeding area 901*a* that is situated inwardly of the heating-side maximum area outer edges 901*e*.

As shown in FIG. 3, the positions corresponding to the heating-side maximum area outer edges 901*e* in the paper width direction D2 are called "maximum area outer edge corresponding positions 761*e*." The length of the heating-side maximum paper-feeding area 901*a* in a direction parallel to the paper width direction D2 is called "maximum feeding width W1." The lengths of sheets of paper T of respective sizes transported in the heating-side maximum paper-feeding area 901*a* in the paper width direction D2 are called "paper-feeding widths" of the sheets of paper T.

An area disposed outwardly of the corresponding paper-feeding area and through which a sheet of paper T does not pass when the sheet of paper T is transported to the fixing nip section F is also called "non-paper-feeding area." According to some embodiments, for example, an area that a sheet of paper T having the maximum length in the paper width direction D2 does not pass (an area outside the maximum paper-feeding area 901) when this sheet of paper T is transported to the fixing nip section F is also called "maximum non-paper-feeding area 903."

In the fixing device 9 according to some embodiments, a minimum paper-feeding area 902 is set. The minimum paper-feeding area 902 serves as a paper-feeding area that a sheet of paper T having a minimum length (minimum width) in the paper width direction D2 passes when this sheet of paper T is transported to the fixing nip section F. For example, the minimum paper-feeding area 902 is formed (set) at the outer peripheral surface of the heating rotating belt 93 and the outer peripheral surface of the pressing rotating member 9*b*. The minimum paper-feeding area 902 is set for every printer 1. The minimum paper-feeding area is capable of accepting an A5-size sheet of paper T when the A5-size sheet of paper T is transported to the fixing nip section F with a short side of the A5-size sheet of paper T being parallel to the paper width direction D2 (the sheet of paper T being an A5 portrait size sheet of paper).

More specifically, a heating-side minimum paper-feeding area 902*a* is formed (set) as the minimum paper-feeding area 902 of the heating rotating member 9*a* at the outer peripheral surface of the heating rotating belt 93. A pressing-side minimum paper-feeding area 902*b* corresponding to the heating-side minimum paper-feeding area 902*a* of the heating rotating belt 93 is formed (set) at the outer peripheral surface of the pressing rotating member 9*b*.

When a sheet of paper T having the minimum length (minimum width) passes the heating-side minimum paper-feeding area 902*a*, the positions corresponding to the outer edges of the sheet of paper T in the paper width direction D2 correspond to heating-side minimum area outer edges 902*e* which are outer edges of the heating-side minimum paper-feeding area 902*a*. That is, the sheet of paper T having the minimum length is transported in the heating-side minimum paper-feeding area 902*a* which is an area situated inwardly of the heating-side minimum area outer edges 902*e*.

The positions corresponding to the heating-side minimum area outer edges 902*e* in the paper width direction D2 are called "minimum area outer edge corresponding positions 762*e*." The length of the heating-side minimum feeding area 902*a* in a direction parallel to the paper width direction D2 is called "minimum feeding width W2."

In the fixing device 9 according to some embodiments, an intermediate paper-feeding area 904 is set as a paper-feeding area where a sheet of paper having an intermediate length (intermediate width) passes when this sheet of paper T is transported to the fixing nip section F. The length of the sheet of paper T having the intermediate length is shorter than the maximum length (maximum width) and longer than the minimum length (minimum width) in the paper width direction D2. For example, the intermediate paper-feeding area 904 is formed (set) at the outer peripheral surface of the heating rotating belt 93 and the outer peripheral surface of the heating rotating member 9*b*. The intermediate paper-feeding area 904 is capable of accepting, for example, an A4-size sheet of paper T when the A4-size sheet of paper T is transported to the fixing nip section F with a short side of the A4-size sheet of paper T being parallel to the paper width direction D2 (the sheet of paper T being an A4 portrait size sheet of paper). The intermediate feeding area 904 is set for every printer 1.

More specifically, a heating-side intermediate paper-feeding area 904*a* is formed (set) as the intermediate paper-feeding area 904 of the heating rotating member 9*a* at the outer peripheral surface of the heating rotating belt 93. A pressing-side intermediate paper-feeding area 904*b* is formed (set) at the outer peripheral surface of the pressing rotating member 9*b* in correspondence with the heating-side intermediate paper-feeding area 904*a* of the heating rotating belt 93.

The positions corresponding to outer edges of the sheet of paper T having the intermediate length (intermediate width) in the paper width direction D2 when this sheet of paper T passes the heating-side intermediate paper-feeding area 904*a* become heating-side intermediate area outer edges 904*e* serving as outer edges of the heating-side intermediate paper-feeding area 904*a*. That is, the sheet of paper T having the intermediate length is transported to the heating-side intermediate paper-feeding area 904*a* that is situated inwardly of the heating-side intermediate area outer edges 904*e*.

The positions corresponding to the heating-side intermediate area outer edges 904*e* in the paper width direction D2 are called "intermediate area outer edge corresponding positions 764*e*." The length of the heating-side intermediate paper-feeding area 904*a* in a direction parallel to the paper width direction D2 is called "intermediate paper-feeding width W4."

The heating unit 70 will be described. As shown in FIGS. 2A to 3, the heating unit 70 includes the induction coil 71 and a magnetic member core section 72. The induction coil 71 is separated from the outer peripheral surface (outer surface) of the heating rotating belt 93 by a predetermined distance, and is disposed along the outer peripheral surface of the heating rotating belt 93. According to some embodiments, the induction coil 71 that is previously wound is disposed at the heating unit 70 so that its longitudinal direction is parallel to the paper width direction D2. The induction coil 71 may be formed by winding wire rod lengthwise in the paper width direction D2 in plan view (that is, when viewed from above in FIGS. 2A to 3) in the heating unit 70.

In order to generate a predetermined heating value by induction heating (IH) from the heating-side maximum paper-feeding area 901*a* (maximum paper-feeding area 901) of the heating rotating belt 93, the induction coil 71 is formed longer than the heating rotating belt 93 in the paper width direction D2.

The induction coil 71 are disposed so that copper litz wire forming the induction coil 71 extends in the paper width direction D2 and is provided side by side along a circumferential direction of the heating rotating belt 93. The induction coil 71 is disposed so as to oppose substantially half of the outer peripheral surface at an upper side in a vertical direction of the heating rotating belt 93.

As shown in FIGS. 2A to 3, the induction coil 71 is disposed so as to surround a central area 718 extending in the direction of the first rotation axis J1 (the paper width direction D2). The central area 718 includes an area that is long in the direction of the first rotation axis J1 and where the wire rod of the induction coil 71 is not disposed. The central area 718 is situated above an uppermost portion of the heating rotating belt 93 in the vertical direction at substantially the center of the heating rotating belt 93 in the transportation direction D1. According to some embodiments, a lower portion in the vertical direction of a center core section 73 of an upper core 75 (described later) is disposed at the central area 718.

When the induction coil 71 is disposed at the heating unit 70, the induction coil 71 is formed so as to be disposed as follows. That is, an inner peripheral edge of the induction coil 71 (portion where a wire rod 711A is disposed) surrounds the central area 718. The wire rod forming the induction coil 71 extends in the paper width direction D2. In FIGS. 2A to 2C, sections of the wire rod forming the induction coil 71 are disposed side by side along the circumferential direction of the heating rotating belt 93 from the inner peripheral edge of the induction coil 71. An outer peripheral edge of the induction coil 71 (a portion where a wire rod 711B is disposed) opposes the outer peripheral surface of the heating rotating belt 93.

According to some embodiments, the induction coil 71 is secured on a supporting member (not shown) formed of a heat-resistant resin material. The supporting member is formed in a semicylindrical shape in cross section so as to extend along the outer peripheral surface (outer surface) at the upper side in the vertical direction of the heating rotating belt 93, and is disposed apart from the outer peripheral surface of the heating rotating belt 93 by a predetermined distance.

The induction coil 71 is connected to an induction heating circuit section (not shown). Alternating current of a predetermined frequency is applied to the induction coil 71 from the induction heating circuit section. By applying the alternating current from the induction heating circuit section, the induction coil 71 generates magnetic fluxes for causing the heating rotating belt 93 to generate heat.

As shown in FIGS. 2A to 2C, the magnetic fluxes generated by the induction coil 71 is guided to the magnetic paths formed by the heating rotating belt 93 and the magnetic member core section 72 (described later).

The magnetic paths are formed by the heating rotating belt 93 and the magnetic member core section 72 so that the magnetic fluxes generated by the induction coil 71 extend along circulation directions R3. The term "circulation direction R3" refers to a direction which passes outwardly of an outer side of the outer peripheral edge and inwardly of the inner peripheral edge of the induction coil 71, and surrounds the wire rod of the induction coil 71. The magnetic fluxes generated by the induction coil 71 passes through the magnetic paths.

The magnetic fluxes generated by the induction coil 71 primarily includes two magnetic fluxes that pass through two magnetic paths and that extend along the circulation direction R3 symmetrically at a downstream side and an upstream side of the central area 718 in the transportation direction D1 of the sheet of paper T. The central area 718 is a portion which is inside of the inner peripheral edge of the induction coil 71 and where the wire rod of the induction coil 71 is not disposed.

The two magnetic fluxes that extend symmetrically at the downstream side and the upstream side in the transportation direction D1 of the sheet of paper T merge at the center core section 73 (described later) of the upper core 75 (described later). The directions of the two magnetic fluxes generated by the induction coil 71 are the same at portions where the two magnetic fluxes, one of which is formed at the downstream side and the other of which is fanned at the upstream side in the transportation direction D1 of the sheet of paper T, oppose each other.

Since the alternating current of a predetermined frequency is applied from the induction heating circuit section (not shown), the magnitude and direction of the magnetic fluxes generated by the induction coil 71 change due to periodic variations of the alternating current to positive or negative. Induced current (eddy current) is generated at the heating rotating belt 93 by such changes of the magnetic fluxes.

As shown in FIGS. 2A to 2C, the magnetic member core section 72 forms the magnetic paths extending along the circulation direction R3. Since the main constituent of the magnetic member core section 72 is ferromagnetic material, the magnetic member core section 72 forms the magnetic paths which are the paths for the magnetic fluxes generated by the induction coil 71. This is because the magnetic permeability of the magnetic member core section 72 whose main constituent is ferromagnetic material is selected to be higher than the magnetic permeability of surrounding air. The magnetic fluxes generated by the induction coil 71 pass through the magnetic member core section 72 that forms the magnetic paths, and are guided to the heating rotating belt 93.

The magnetic member core section 72 forms the two magnetic paths extending symmetrically at the downstream side and the upstream side of the central area 718 where the wire rod of the induction coil 71 are not disposed in the transportation direction D1 of the sheet of paper T.

As shown in FIGS. 2A to 2C, the magnetic member core section 72 includes the upper core 75, pairs of side cores 76 serving as third core sections, and the pair of first magnetic flux shielding members 78 serving as a magnetic flux shielding member. The upper core 75 and the side cores 76 are magnetic member cores formed by sintering, for example, ferrite powder which is ferromagnetic material.

The upper core 75 will be described in detail. The upper core 75 are formed by integrating the center core section 73 serving as second core section to pairs of arch core sections 74 serving as first core sections. When the center core section 73 is viewed in the paper width direction D2, the center core section 73 is disposed above the heating rotating member 9*a* in the vertical direction at substantially the center of the heating rotating member 9*a* in the transportation direction D1 of the sheet of paper T.

The arch core sections 74 form pairs at a downstream side and an upstream side of the center core section 73 in the transportation direction D1 of the sheet of paper T. The center core section 73 and the pairs of arch core sections 74 are continuously integrally formed side by side along the circulation direction R3 of the magnetic paths at predetermined positions in the paper width direction D2.

As shown in FIGS. 2A to 2C, the center core section 73 is used to form the magnetic paths between the heating rotating belt 93 and the arch core sections 74 (described later) in the circulation direction R3. The center core section 73 is disposed near the central area 718 (that is, near the wire rod 711A disposed at the inner peripheral edge of the induction coil 71).

When the center core section 73 is viewed from the paper width direction D2, the center core section 73 has a substantially rectangular shape that is long in the vertical direction. The center core section 73 opposes the outer peripheral surface of the heating rotating belt 93 so as to be separated therefrom by a predetermined distance. The center core section 73 has a surface that opposes the outer peripheral surface of the heating rotating belt 93 without interposing the induction coil 71 therebetween.

A surface of the center core section 73 at a side opposite to the surface of the center core section 73 that opposes the outer peripheral surface of the heating rotating belt 93 is exposed so as to face upward in the vertical direction. Side surfaces of the center core section 73 at the downstream side and the upstream side in the transportation direction D1 of the sheet of paper T are connected to the pairs of arch core sections 74 (described later) at predetermined positions in the paper width direction D2.

As shown in FIG. 3, the center core section 73 has a substantially rectangular parallelepiped shape that is long in the paper width direction D2. The center core section 73 is longer than the maximum paper-feeding width W1 of a sheet of paper T having the maximum length in the paper width direction D2.

The pairs of arch core sections 74 extend upstream and downstream in the transportation direction D1 of the sheet of paper T from the upper side of the side surfaces of the center core section 73. As shown in FIGS. 2A to 2C, the pairs of arch core sections 74 form magnetic paths opposed to the heating rotating belt 93 interposing the induction coil 71 therebetween in the circulation direction R3 (that is, at the outer side of the induction coil 71). The pairs of arch core sections 74 are capable of reducing leakage the magnetic fluxes, which are generated by the induction coil 71, to an outer side, and guiding the magnetic fluxes to the heating rotating belt 93.

The pairs of arch core sections 74 are connected to the center core section 73 with the center core section 73 being interposed therebetween in transportation direction D1 of the sheet of Paper T. The pairs of arch core sections 74 form pairs at the downstream side and the upstream side in the transportation direction D1 of the sheet of Paper T. The pairs of arch core sections 74 form arches extending along the circumferential direction of the heating rotating belt 93.

The pairs of arch core sections 74 have shapes that are symmetrical on the downstream side and the upstream side in the transportation direction D1 of the sheet of Paper T with respect to the center core section 73. More specifically, each arch core section 74 has a horizontal portion 742 and an oblique portion 743. When each horizontal portion 742 is viewed in the paper width direction D2, each horizontal portion 742 extends continuously from the upper side of the center core section 73 and extends horizontally in the downstream side or the upstream side in the transportation direction D1 of the sheet of Paper T by a predetermined distance.

As shown in FIGS. 2A to 2C, when each oblique portion 743 is viewed in the paper width direction D2, each oblique portion 743 extends obliquely downward in a straight line by extending continuously from a side of the corresponding horizontal portion 742 opposite to the corresponding center core section 73 towards the downstream side or the upstream side in the transportation direction D1 of the sheet of Paper T. Each oblique portion 743 extends towards a location near the outer side of the outer peripheral edge of the induction coil 71 at the downstream side or the upstream side in the transportation direction D1 of the sheet of Paper T.

Each oblique portion 743 has an oblique end portion 744. Each oblique end portion 744 is an end portion of the oblique portion 743 at the downstream side or the upstream side in the transportation direction D1 of the sheet of Paper T. In other words, each oblique end portion 744 is an end portion of its corresponding arch core section 74 at a side opposite to the center core section 73. An oblique end surface 744A is formed at an end of the oblique end portion 744. Each oblique end surface 744A faces downward in the vertical direction, and extends parallel to the horizontal direction.

As shown in FIG. 3, the pairs of arch core sections 74 are disposed apart from each other by a predetermined distance in the paper width direction D2. In an entire area corresponding to the maximum paper-feeding area 901, the pairs of arch core sections 74 are disposed side by side so as to be separated from each other by the predetermined distance in the paper width direction D2. When the pairs of arch core sections 74 are viewed in the transportation direction D1 of the sheet of paper T, the arch core sections 74 each have a predetermined width in the transportation direction D1 of the sheet of paper T.

By disposing the pairs of arch core sections 74 apart from each other in the paper width direction D2 by the predetermined distance, the magnetic fluxes generated by the induction coil 71 pass through pairs of magnetic paths formed by the pairs of arch core sections 74 virtually without the magnetic fluxes passing through air between the pairs of arch core sections 74 in the paper width direction D2. Accordingly, the pairs of arch core sections 74 form the pairs of magnetic paths that are separated from each other in the paper width direction D2 and that extend in the circulation direction R3.

Since the center core section 73 and the side cores 76 (described later) are long in the paper width direction D2, the magnetic fluxes that have passed through the pairs of arch core sections 74 so as to be separated from each other in the paper width direction D2 are dispersed or merged so that they are made uniform in the paper width direction D2 by the magnetic paths formed by the center core section 73 or the side cores 76, after which they are guided to the heating rotating belt 93.

The pair of first magnetic flux shielding members 78 will be described in detail. As shown in FIGS. 2A to 2C, the pair of first magnetic flux shielding members 78 is disposed so that one is provided at the downstream side and the other is provided at the upstream side in the transportation direction D1 of the sheet of paper T with the heating rotating member 9*a* being disposed therebetween. The pair of first magnetic flux shielding members 78 is disposed at sides of the oblique end portions 744 of the respective arch core sections 74 and near the outer peripheral edge 711B of the induction coil 71.

The pair of first magnetic flux shielding members 78 is formed so as to have a substantially rectangular parallelepiped shape that is flat and long in the paper width direction D2. When the pair of first magnetic flux shielding members 78 is viewed in the paper width direction D2, the pair of first magnetic flux shielding members 78 each has a substantially rectangular shape that is long in the transportation direction D1 of the sheet of paper T.

In the description below, since the pair of first magnetic flux shielding members 78 is symmetrically disposed at the upstream side and the downstream side of the heating rotating member 9*a* in the transportation direction D1 of the sheet of paper T, only one of the first magnetic flux shielding members 78 may be described. In this case, for the other first magnetic flux shielding member 78, the description of one of the first magnetic flux shielding members 78 may be referred to or applied when necessary.

The pair of first magnetic flux shielding members 78 is disposed so as to be separated from the oblique end portions 744 of the respective arch core sections 74 by a predetermined distance below the oblique end portions 744 in the vertical direction. The pair of first magnetic flux shielding members 78 is disposed so that portions of upper sides thereof oppose the oblique end surfaces 744A of the arch core sections 74.

The distances between the upper surfaces of the pair of first magnetic flux shielding members 78 and the oblique end surfaces 744A of the pairs of arch core sections 74 are distances that allow the side cores 76 (described later) to be disposed. Although described in detail below, when the side cores 76 are disposed between the first magnetic flux shielding members 78 and the arch core sections 74, the side cores 76 are disposed in contact with or close to the oblique end portions 744 of the arch core sections 74.

The first magnetic flux shielding member 78 has a first opposing surface 781 that opposes the outer peripheral surface of the heating rotating belt 93 without interposing the induction coil 71. The first opposing surface 781 is disposed apart from the outer peripheral surface (outer surface) of the heating rotating belt 93 by a separation distance K0.

The first magnetic flux shielding member 78 extends horizontally from a position that is separated from the outer peripheral surface (outer surface) of the heating rotating belt 93 by the separation distance K0 and away from (that is, downstream or upstream in the transportation direction D1 of the sheet of paper T) the outer peripheral surface of the heating rotating belt 93. The pair of first magnetic flux shielding members 78 extends from the positions that are separated from the outer peripheral surface of the heating rotating belt 93 by the separation distance K0 to positions that are beyond the lower sides of the oblique end portions 744 of the arch core sections 74.

The pair of magnetic flux shielding members 78 is formed of a nonmagnetic material having high electrical conductivity. The pair of first magnetic flux shielding members 78 is formed of, for example, oxygen-free copper.

When induced current generated by passing magnetic flux that is vertical to the surface of first magnetic flux shielding member 78 (that faces the corresponding arch cores 74) passes through the first magnetic flux shielding member 78, the first magnetic flux shielding member 78 causes magnetic flux in a direction opposite to that of the magnetic flux that has passed through the first magnetic flux shielding member 78 to be generated. By generating magnetic flux that cancels interlinkage flux (vertical through magnetic flux), the first magnetic flux shielding member 78 reduces or blocks magnetic flux that passes through the magnetic path. By using a conductive member having high conductivity, it is possible to suppress generation of Joule heat resulting from the induced current, and efficiently reduce or block the magnetic flux. In order for the first magnetic flux shielding member 78 to have high conductivity, it is effective to, for example, select a material having a small specific resistance or to thicken the first magnetic flux shielding member 78. According to some embodiments, the plate thickness of the first magnetic flux shielding member 78 is set to be at least 0.5 mm.

The first magnetic flux shielding member 78 reduces magnetic flux. Therefore, the first magnetic flux shielding member 78 is also called "first magnetic flux reducing member 78".

To be described later in detail, when second opposing surfaces 765 of the respective side cores 76 (described below) move towards or away from the outer peripheral surface of the heating rotating belt 93, the pair of first magnetic flux shielding members 78 is capable of reducing or blocking the magnetic flux generated by the induction coil 71.

The pairs of side cores 76 will be described in detail. The pairs of side cores 76 are disposed so that one of each pair is disposed at the downstream side and the other of each pair is disposed at the upstream side in the transportation direction D1 of the sheet of paper T with the heating rotating member 9*a* being disposed therebetween. The pairs of side cores 76 are disposed at sides of the pair of first magnetic flux shielding members 78 facing the oblique end portions 744 of the pairs of arch core sections 74, and are disposed at the upper sides of the pair of first magnetic flux shielding members 78.

The pairs of side cores 76 are substantially rectangular parallelepipeds that are flat and long in the paper width direction D2. When the pairs of side cores 76 are viewed in the paper width direction D2, they have substantially rectangular shapes that are long in the transportation direction D1 of the sheet of paper T.

In the description below, since the side cores 76 are symmetrically disposed at the upstream side and the downstream side of the heating rotating member 9*a* in the transportation direction D1 of the sheet of paper T, only one of the side cores 76 is described. For the other side core 76, the description of one of the side cores 76 is referred to or applied when necessary.

The side cores 76 are disposed so as to be spaced apart from the outer peripheral surface (outer surface) of the heating rotating belt 93 by a predetermined distance and oppose the outer peripheral surface of the heating rotating belt 93. The side cores 76 each have the second opposing surface 765 that opposes the outer peripheral surface of the heating rotating belt 93 without interposing the induction coil 71 therebetween.

To be described in detail below, by moving the side cores 76 so that they move towards or away from the heating rotating belt 93, the second opposing surfaces 765 can be positioned away from the outer peripheral surface of the heating rotating belt 93 by a first distance K1 or a second distance K2. According to some embodiments, the side cores 76 are such that they are capable of being positioned away from the outer peripheral surface of the heating rotating belt 93 by the first distance K1 or the second distance K2. However, the side cores 76 are such that they may be capable of being positioned away from the outer peripheral surface of the heating rotating belt 93 by any distance between the first distance K1 and the second distance K2.

The side cores 76 extend horizontally away from the outer peripheral surface of the heating rotating belt 93 (downstream or upstream in the transportation direction D1 of the sheet of paper T) from respective positions of the second opposing surfaces 765 that are separated from the outer peripheral surface (outer surface) of the heating rotating belt 93 by the first distance K1 or the second distance K2. The length of each side core 76 in the transportation direction D1 of the sheet of paper T is substantially the same as that of the first magnetic flux shielding member 78. The lengths of the side cores 76 in the transportation direction D1 of the sheet of paper T are set so as to allow the side cores 76 to overlap the first magnetic flux shielding members 78 when the side cores 76 are disposed at the positions (first positions 11 described later) that are separated by the first distance K1 from the outer peripheral surface (outer surface) of the heating rotating belt 93. In addition, the lengths of the side cores 76 can be longer than the length of the first magnetic flux shielding member 78.

As shown in FIGS. 3 to 4C, the side cores 76 are disposed side by side each other along the paper width direction D2. The side cores 76 are disposed side by side each other without space in the paper width direction D2. An overall range in which the side cores 76 are disposed side by side each other in the paper width direction D2 is longer than the maximum paper-feeding width W1 in the paper width direction D2.

The side cores 76 are a first side core 76A, a pair of second side cores 76B, a pair of third side cores 76C, and a pair of fourth side cores 76D. The side cores 76 are disposed so that, with the first side core 76A disposed at the center in the paper width direction D2 being the center, the second side cores 76B, the third side cores 76C, and the fourth side cores 76D are disposed in that order outward from the first side core 76A in the paper width direction D2. With the first side core 76A being the center, the second side cores 76B, the third side cores 76C, and the fourth side cores 76D form pairs outward from the first side core 76A in the paper width direction D2.

The first side core 76A, the pair of second side cores 76B, the pair of third side cores 76C, and the pair of fourth side cores 76D have predetermined lengths in the paper width direction D2 in correspondence with paper-feeding areas of sheets of paper T of respective sizes.

More specifically, as shown in FIG. 3, the first side core 76A extends from one of the minimum area outer edge corresponding position 762*e* to the other minimum area outer edge corresponding position 762*e*. One of the pair of second side cores 76B extends from one of the minimum area outer edge corresponding positions 762*e* to one of the intermediate area outer edge corresponding positions 764*e* at a side opposite to the first side core 76A (that is, outer side in the paper width direction D2) and the other of the pair of second side cores 76B extends from the other minimum area outer edge corresponding position 762*e* to the other intermediate area outer edge corresponding position 764*e* at a side opposite to the first side core 76A (that is, outer side in the paper width direction D2).

One of the pair of third side cores 76C extends from one of the intermediate area outer edge corresponding positions 764*e* to one of the maximum area outer edge corresponding positions 761*e* at the side opposite to the first side core 76A (that is, outer side in the paper width direction D2) and the other of the pair of third side cores 76C extends from the other intermediate area outer edge corresponding position 764*e* to the other maximum area outer edge corresponding position 761*e* at the side opposite to the first side core 76A (that is, outer side in the paper width direction D2). The pair of fourth side cores 76D extends outward in the paper width direction D2 from the respective maximum area outer edge corresponding positions 761*e*.

Here, the role of the side cores 76 when sheets of paper T of respective sizes are fed to the fixing nip section F will be described. To be described in detail later, by moving a predetermined side core 76 among the pairs of side cores disposed in correspondence with areas outside the paper-feeding areas, the magnetic flux generated by the induction coil 71 is reduced or blocked. This is used to suppress an excessive temperature increase of the areas outside the paper-feeding areas (non-paper-feeding areas) of the heating rotating belt 93.

For example, when an A5 portrait size sheet of paper T is fed to the fixing nip section F, this sheet of paper T passes through the heating-side minimum paper-feeding area 902*a* of the heating rotating belt 93. The pair of second side cores 76B, the pair of third side cores 76C, and the pair of fourth side cores 76D are movably disposed at the areas outside the heating-side minimum paper-feeding area 902*a* for when the A5 portrait size sheet of paper T is fed. Therefore, by moving the pair of second side cores 76B, the pair of third side cores 76C, and the pair of fourth side cores 76D, an excessive temperature increase of the non-paper-feeding areas of the heating rotating belt 93 is suppressed.

For example, when an A4 portrait size sheet of paper T is fed to the fixing nip section F, this sheet of paper T passes through the heating-side intermediate paper-feeding area 904*a* of the heating rotating belt 93. The pair of third side cores 76C and the pair of fourth side cores 76D are movably disposed at the areas outside the heating-side intermediate paper-feeding area 904*a* for when the A4 portrait size sheet of paper T is fed. Therefore, by moving the pair of third side cores 76C and the pair of fourth side cores 76D, an excessive temperature increase of the non-paper-feeding areas of the heating rotating belt 93 is suppressed.

For example, when an A3 portrait size sheet of paper T is fed to the fixing nip section F, this sheet of paper T passes in the heating-side maximum paper-feeding area 901*a* of the heating rotating belt 93. The pair of fourth side cores 76D is movably disposed at the areas outside the heating-side maximum paper-feeding area 901*a* for when the A3 portrait size sheet of paper T is fed. Therefore, by moving the pair of fourth side cores 76D, an excessive temperature increase of the non-paper-feeding areas of the heating rotating belt 93 is suppressed.

At the sides of the pair of first magnetic flux shielding members 78 facing the oblique end portions 744 of the pairs of arch core sections 74, the pairs of side cores 76 are movable so that the second opposing surfaces 765 of the pairs of side cores 76 can move towards or away from the outer peripheral surface of the heating rotating belt 93.

More specifically, by moving the side cores 76 so that the second opposing surfaces 765 of the side cores 76 move towards or away from the outer peripheral surface of the heating rotating belt 93, the side cores 76 are movable to the first positions I1 and second positions I2.

As shown in FIG. 2A, the first positions 11 of the side cores 76 are positions where the second opposing surfaces 765 of the side cores 76 are separated from the outer peripheral surface of the heating rotating belt 93 by the first distance K1 (which is equal to or less than the distance K0) and oppose the outer peripheral surface of the heating rotating belt 93. As mentioned above, since the length of each side core 76 in transportation direction D1 of the sheet of paper T is substantially the same as that of the first magnetic flux shielding member 78, the first distance K1 is substantially the same as the separation distance K0. However, when the length of each side core 76 in the transportation direction D1 of the sheet of paper T is longer than that of the first magnetic flux shielding member 78, the first distance K1 becomes shorter than the separation distance K0. As shown in FIGS. 2B and 2C, the second positions I2 of the side cores 76 are positions where the second opposing surfaces 765 of the side cores 76 are separated from the outer peripheral surface of the heating rotating belt 93 by the second distance K2 (which is greater than the distance K0), and oppose the outer peripheral surface of the heating rotating belt 93.

As shown in FIG. 2A, when the side cores 76 are positioned at the first positions I1, the positions of the second opposing surfaces 765 of the side cores 76 are positions that are the same as the positions of the first opposing surfaces 781 of the pair of first magnetic flux shielding members 78, or are positions that are closer to the outer peripheral surface of the heating rotating belt 93 than the positions of the first opposing surfaces 781 of the pair of first magnetic flux shielding members 78.

That is, when the side cores 76 are positioned at the first positions I1, and the side cores 76 are viewed from the upper side in the vertical direction, the side cores 76 overlap the pair of first magnetic flux shielding members 78 so as to cover the entire upper surfaces at oblique-end-portion-744 sides of the pair of first magnetic flux shielding members 78. This causes the magnetic fluxes generated by the induction coil 71 to be guided to the side cores 76 having high magnetic permeability without passing through the pair of first magnetic flux shielding members 78 (see FIG. 2A).

In contrast, as shown in FIGS. 2B and 2C, when the side cores 76 are positioned at the second positions I2, the positions of the second opposing surfaces 765 of the side cores 76 are positions that are further away from the outer peripheral surface of the heating rotating belt 93 than the positions of the first opposing surfaces 781 of the pair of first magnetic flux shielding members 78.

That is, when the side cores 76 are positioned at the second positions I2, and the side cores 76 are viewed from the upper side in the vertical direction, the side cores 76 are positioned so as not to overlap part of or the entire upper surfaces of the pair of first magnetic flux shielding members 78 at the oblique-end-portion-744 sides.

By this, the magnetic fluxes generated by the induction coil 71 are guided to the pairs of side cores 76 and pass through the pair of first magnetic flux shielding members 78 (see FIG. 2B), or pass through the pair of first magnetic flux shielding members 78 without being guided to the pairs of side cores 76 (see FIG. 2C). Therefore, when the side cores 76 are positioned at the second positions I2, the pair of first magnetic flux shielding members 78 is capable of reducing or blocking the magnetic flux generated by the induction coil 71.

Here, it can be said that the first positions I1 of the side cores 76 are magnetic path formation positions where the side cores 76 each form part of a magnetic path. The second positions I2 of the side cores 76 include the 2A positions I2A corresponding to the magnetic path formation positions where the side cores 76 each form part of the magnetic path, and the 2B positions I2B corresponding to magnetic path non-formation positions where the side cores 76 do not form magnetic paths.

The magnetic path formation positions of the side cores 76 are positions where the side cores 76 are positioned between the arch core sections 74 and the first magnetic flux shielding members 78 and form parts of the magnetic paths. The magnetic path non-formation positions of the side cores 76 are positions where the side cores 76 are not positioned between the arch core sections 74 and the first magnetic flux shielding members 78 and do not form parts of the magnetic paths.

When the side cores 76 are positioned at the 2A positions I2A, as shown in FIG. 2B, the second opposing surfaces 765 of the side cores 76 are separated from the outer peripheral surface of the heating rotating belt 93 by a 2A distance K2A. When the side cores 76 are positioned at the 2B positions I2B, as shown in FIG. 2C, the second opposing surfaces 765 of the side cores 76 are separated from the outer peripheral surface of the heating rotating belt 93 by a 2B distance K2B that is longer than the 2A distance K2A.

As understood by a person of ordinary skill in the art, the side cores 76 are not limited to the four movable portions 76A, 7613, 76C, and 76D. The side cores 76 may include a plurality of movable portions. For example, the side cores 76 may include a minimum movable portion at the center and may include at least four or even more movable portions between the minimum movable portion and the maximum outer edge.

As shown in FIGS. 2A to 2C and in FIGS. 4A to 4C, the side cores 76 are fainted so that the side cores 76 can be moved to the first positions I1 or to the second positions I2 by a side core moving section 150 (described later). The side core moving section 150 can move the side cores 76 separately.

The side core moving section 150 will be described. As shown in FIGS. 2A to 2C, the side core moving section 150 includes, corresponding to the pairs of side cores 76, pairs of side core supporting plates 151, a pair or pairs of securing members 152, pairs of cam rotating shaft members 153, pairs of eccentric cams 154, pairs of urging members 155, and a driving portion 158 including, for example, a motor. The pairs of side core supporting plates 151, the pairs of securing members 152, and the pairs of eccentric cams 154 are formed of heat-resistant resin materials.

The pairs of side core supporting plates 151 support the respective pairs of side cores 76, and are disposed so that the corresponding side cores 76 are disposed between the pairs of side core supporting plates 151 and the heating rotating member 9*a*.

When the pairs of side core supporting plates 151 are viewed in the paper width direction D2, the pairs of side core supporting plates 151 extend in the paper width direction D2 in the form of vertically long plates and with lengths corresponding to those of the corresponding side cores 76.

Lower ends in the vertical direction of the side core supporting plates 151 are secured to end portions of the respective side cores 76 at sides opposite to the heating rotating belt 93. The side core supporting plates 151 are formed so as to be movable horizontally from the downstream side to the upstream side in the transportation direction D1 of the sheet of paper T or horizontally from the upstream side to the downstream side in the transportation direction D1 of the sheet of paper T while the side core supporting plates 151 are kept oriented so as to be long in the vertical direction and support the side cores 76.

At an upper side of the side core supporting plates 151 in the vertical direction, the pair or pairs of securing members 152 are disposed so as to be separated in the upstream direction or the downstream direction from the side core supporting plates 151 in the transportation direction D1 of the sheet of paper T by a predetermined distance, and so as to oppose heating-rotating-member-9*a* sides of the side core supporting plates 151. The pair or pairs of securing members 152 are long plates in the paper width direction D2. The pair or pairs of securing members 152 may be formed of one member that is long in the paper width direction D2 or a plurality of members in correspondence with the pairs of side cores 76. The pair or pairs of securing members 152 are secured to, for example, the case of the fixing device 9.

The pairs of urging members 155 are disposed between the pairs of side core supporting plates 151 and the pair or pairs of securing members 152. The pairs of urging members 155 urge the pairs of side core supporting plates 151 away from the heating rotating member 9*a*.

The pairs of cam rotating shaft members 153 are disposed so as to be separated from sides of the pairs of side core supporting plates 151 that are opposite to the heating rotating member 9*a*, and are long in the paper width direction D2. The pairs of cam rotating shaft members 153 are rotatable around rotation axes J3 that are parallel to the paper width direction D2. The pairs of cam rotating shaft members 153 are rotatably supported by, for example, the case of the fixing device 9.

The pairs of eccentric cams 154 are secured to the pairs of cam rotating shaft members 153, and have a plurality of cam surfaces whose distances from the pairs of cam rotating shaft members 153 differ. The cam surfaces of the pairs of eccentric cams 154 contact the sides of the pairs of side core supporting plates 151 that do not oppose the heating rotating member 9*a*.

With the cam surfaces of the pairs of eccentric cams 154 being in contact with the side core supporting plates 151, the earn surfaces are urged by the urging members 155 through the pairs of side core supporting plates 151.

The pairs of eccentric cams 154 are rotated when the driving portion 158 rotates the pairs of cam rotating shaft members 153. The driving portion 158 is formed so as to be capable of separately rotationally driving the pairs of cam rotating shaft members 153. The driving portion 158 rotates the pairs of eccentric cams 154 so that the cam surfaces that contact the side core supporting plates 151 are changed. Therefore, the positions of the side core supporting plates 151 in the transportation direction D1 of the sheet of paper T change. The driving portion 158 includes, for example, multiple motors.

Accordingly, when the driving portion 158 rotates the pairs of eccentric cams 154 corresponding to the pairs of side cores 76 through the pairs of cam rotating shaft members 153, the pairs of side core supporting plates 151 corresponding to the pairs of side cores 76 move towards or away from the outer peripheral surface of the heating rotating belt 93. Therefore, the distances between the pairs of side cores 76, supported by the pairs of side core supporting plates 151, and the outer peripheral surface of the heating rotating belt 93 change. Consequently, driving of the driving portion 158 causes the side core moving section 150 to move the pairs of side cores 76 to the first positions 11 or to the second positions I2.

Coping method of the different sizes (feeding widths) of sheets of paper T are realized by reducing or blocking the magnetic fluxes generated by the induction coil 71 at the non-paper-feeding areas of the heating rotating belt 93 by moving the pairs of side cores 76, disposed in accordance with the non-paper-feeding areas of the sheets of paper T of the respective sizes, to the second positions I2. This suppresses an excessive temperature increase of the non-paper-feeding areas of the heating rotating belt 93 corresponding to the sheets of paper T of the respective sizes.

Depending upon the sizes of the sheets of paper T, predetermined lengths and arrangements of the side cores 76 may not correspond to the paper-feeding areas where the sheets of paper T pass and the areas outside the paper-feeding areas. More specifically, according to some embodiments, the paper-feeding width of a B4 portrait size sheet of paper T is a paper-feeding width between the intermediate paper-feeding width W4 of an A4 portrait size sheet of paper T (having intemiediate length) and the maximum paper-feeding width W1 of an A3 portrait size sheet of paper T (having the maximum length). Therefore, when the B4 portrait size sheet of paper T is fed to the fixing nip section F, boundaries between a paper-feeding area and an area outside the paper-feeding area correspond to portions situated partway in the third side cores 76C in the paper width direction D2.

In this case, as shown in FIGS. 2B and 4B, when the pair of third side cores 76C is viewed from the upper side in the vertical direction, actions to be taken is to move the pair of third side cores 76C to the 2A positions I2A so that parts of the oblique-end-portion-744 side surfaces of the pair of first magnetic flux shielding members 78 do not overlap the third side cores 76C.

Therefore, at the areas of the heating rotating belt 93 corresponding to the areas where the pair of third side cores 76 is disposed, when necessary, the temperature of the heating rotating belt 93 can be adjusted to a temperature that is between the temperature when paper-feeding is performed and the temperature when paper-feeding is not performed. Therefore, at the areas of the heating rotating belt 93 corresponding to the areas where the pair of third side cores 76C is disposed, it is possible to suppress an excessive temperature increase of the heating rotating belt 93 at the non-paper-feeding areas, and to cause the heating rotating belt 93 to be heated within the paper-feeding area.

The temperature sensors 95 will be described. The temperature sensors 95 detect the temperature of the outer peripheral surface of the heating rotating belt 93. According to some embodiments, as shown in FIGS. 2A to 2C, the temperature sensors 95 are disposed near the lower side in the vertical direction of the first magnetic flux shielding member 78 disposed at the upstream side in the transportation direction D1 of the sheet of paper T so as to oppose the outer peripheral surface of the heating rotating belt 93 without contacting the outer peripheral surface of the heating rotating belt 93. The temperature sensors 95 are disposed at respective predetermined intervals in the paper width direction D2. The temperature sensors 95 may be, for example, infrared temperature sensors.

Next, the structure related to control of the fixing device 9 will be described. As shown in FIGS. 2A to 2C and in FIGS. 4A to 4C, the printer 1 includes a receiving section 101, a controlling section 110, and a storage section 120.

The receiving section 101 is capable of receiving image formation instruction information including size information regarding the size of a sheet of paper T. The image formation instruction information includes size information of a sheet of paper T and print surface information of the sheet of paper T received from an operating section (not shown) of the printer 1, and size information of a sheet of paper T received from an external apparatus (such as a personal computer (PC)). The size information includes information regarding a standard of the size of a sheet of paper T (that is, a vertical length and a horizontal length of the sheet of paper T), and information regarding direction of transportation of the sheet of paper T (in a longitudinal direction or a lateral direction).

The controlling section 110 includes a side core movement controlling section 111 serving as a drive controlling section. On the basis of the size information of a sheet of paper T received by the receiving section 101, the side core movement controlling section 111 controls the side core moving section 150 to move the second opposing surface 765 of the predetermined side cores 76 corresponding to the size of the sheet of paper T among the pairs of side cores 76 towards or away from the outer peripheral surface of the heating rotating belt 93 so that the predetermined side cores 76 moves to the first position I1 or the second position I2.

According to some embodiments, on the basis of the size information of the sheet of paper T received by the receiving section 101, the side core movement controlling section 111 performs control so that, when the side cores 76 disposed in correspondence with a non-feeding area of the sheet of paper T is not at a predetermined position, the side cores 76 are moved to the predetermined position.

The storage section 120 stores information regarding which side core 76 is positioned at the non-paper-feeding area corresponding to the size of a corresponding sheet of paper T. The storage section 120 also stores information regarding movement amount of the driving portion 158 of the side core moving section 150.

The storage section 120 stores, for example, the movement amount for moving the driving portion 158 or for the angle of rotation of the eccentric cams 154 from predetermined reference positions when the pairs of side cores 76 are positioned so as to overlap the entire pair of first magnetic flux shielding members 78 as viewed from the upper side in the vertical direction, or when the pairs of side cores 76 are positioned so as not to overlap part of or the entire pair of first magnetic flux shielding members 78 as viewed from the upper side in the vertical direction.

The storage section 120 includes a storage table (not shown). The storage table stores information related to the side cores 76 to be moved in correspondence with the respective sizes of the sheets of paper T associated with information related to the movement amounts thereof. For example, the storage table stores the following pieces of information for when an A3 portrait size sheet of paper T whose length in the paper width direction D2 is the maximum paper-feeding width W1 is to be fed. These pieces of information are information indicating that the side cores 76 that are disposed in correspondence with the non-paper-feeding area of the A3 portrait size sheet of paper T are the fourth side cores 76D, and information regarding the movement amount of the driving portion 158 for moving the fourth side cores 76D to the 2B positions I2B.

For example, the storage table of the storage section 120 stores the following pieces of information for when an A5 portrait size sheet of paper T whose length in the paper width direction D2 is the minimum paper-feeding width W2 is to be fed. These pieces of information are information indicating that the side cores 76 that are disposed in correspondence with the non-paper-feeding area of the A5 portrait size sheet of paper T are the fourth side cores 76D, the third side cores 76C, and the second side cores 76B, and information regarding the movement amount of the driving portion 158 for moving the fourth side cores 76D, the third side cores 76, and the second side cores 76B to the 2B positions I2B.

For example, the storage table of the storage section 120 stores the following pieces of information for when an A4 portrait size sheet of paper T whose length in the paper width direction D2 is the intermediate paper-feeding width W4 is to be fed. These pieces of information are information indicating that the side cores 76 that are disposed in correspondence with the non-paper-feeding area of the A4 portrait size sheet of paper T are the fourth side cores 76D and the third side cores 76C, and information regarding the movement amount of the driving portion 158 for moving the fourth side cores 76D and the third side cores 76C to the 2B positions I2B.

For example, the storage table of the storage section 120 stores the following pieces of information for when a B4 portrait size sheet of paper T whose length in the paper width direction D2 is between the maximum paper-feeding width W1 and the intermediate paper-feeding width W4 is to be fed. These pieces of information are information indicating that the side cores 76 that are disposed in correspondence with the non-paper-feeding areas of the B4 portrait size sheet of paper T are the fourth side cores 76D, information indicating that the boundaries between the paper-feeding area and the non-paper-feeding area correspond to portions that are situated partway in the third side cores 76C in the paper width direction D2, information regarding the movement amount of the driving portion 158 for moving the fourth side cores 76D to the 2B positions I2B, and information regarding the movement amount of the driving portion 158 for moving the third side cores 76C to the 2A positions I2A.

Figure 5:
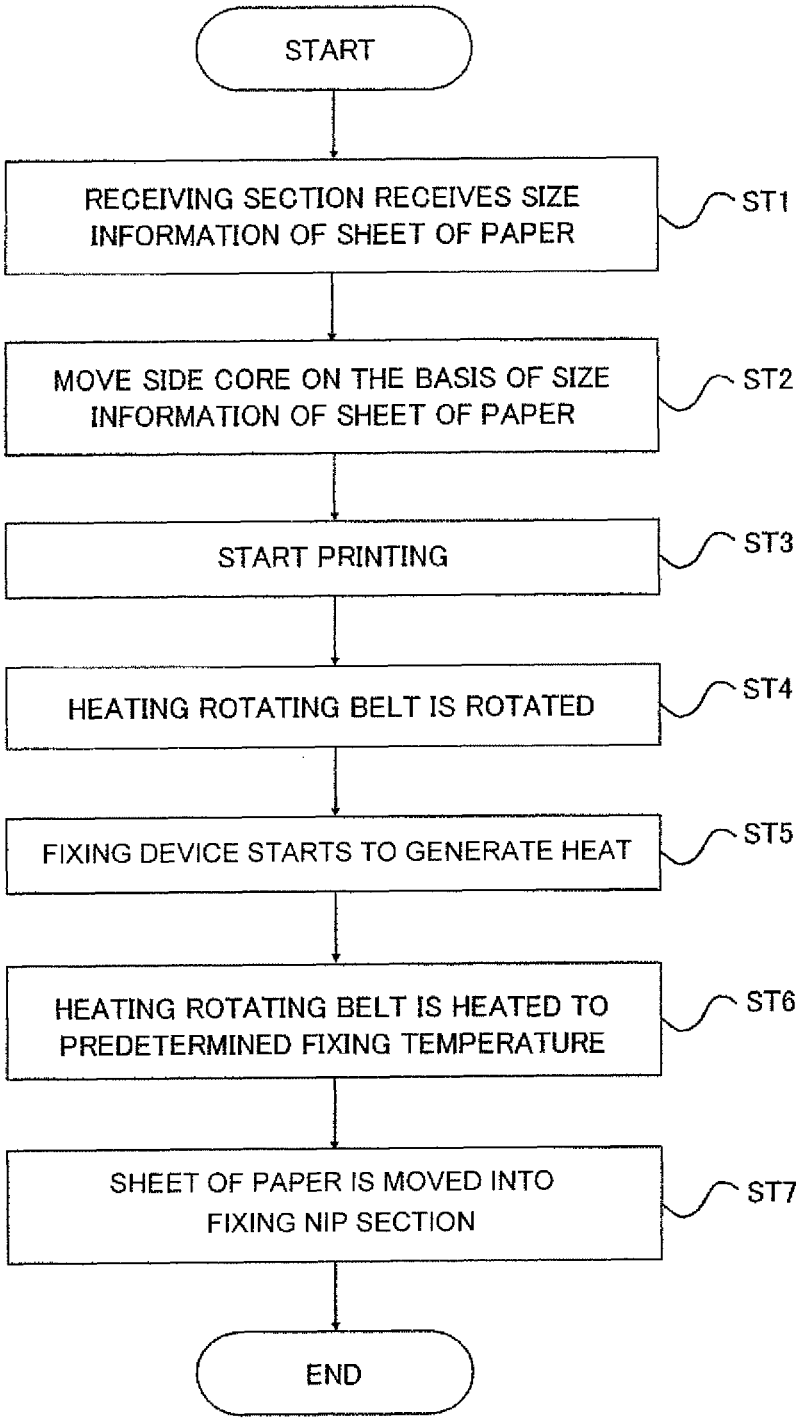
FIG. 5 is a flowchart of an exemplary operation for moving the side cores according to some embodiments.

Next, the operation of the printer 1 including the fixing device 9 according to the embodiment will be described with reference to FIG. 5. According to some embodiments, when a power supply of the printer 1 is turned on, a power supply section (not shown) supplies electric power to the charging section 10, the laser scanner unit 4, the developing device 16, the transfer roller 8, a printer controlling section (not shown), and the fixing device 9. On the basis of a control signal from the printer controlling section, the charging section 10, the laser scanner unit 4, the developing device 16, the transfer roller 8, and the fixing device 9 are controlled.

In Step ST1, the receiving section 101 receives, for example, image formation instruction information that is generated on the basis of operation of the operating section (not shown) disposed outside the printer 1, after the power supply of the printer 1 is turned on.

More specifically, the image formation instruction information input by the operating section includes size information regarding the type of sheets of paper T (the size of the sheets of paper T). The receiving section 101 outputs the received image formation instruction information to the side core movement controlling section 111.

In Step ST2, on the basis of the size information regarding the size of the sheets of paper T received by the receiving section 101, the side cores 76 that are disposed in correspondence with a non-paper-feeding area outside a paper-feeding area of the sheet of paper T when the sheet of paper T of the corresponding size is transported to the fixing nip section F, and that are not positioned at predetermined positions are moved.

For example, when the printer 1 receives a print command for printing a sheet of paper T of intermediate size whose length in the paper width direction D2 is the intermediate paper-feeding width W4 (such as an A4 portrait size sheet of paper T), the side core movement controlling section 111 controls the side core moving section 150 by referring to the storage section 120 on the basis of the size information of the sheets of paper T received by the receiving section 101 (that is, information regarding the lengths of the sheets of paper T in the paper width direction D2).

By this, as shown in FIG. 4C, the pair of fourth side cores 76D and the pair of third side cores 76C corresponding to the non-paper-feeding area of the A4 portrait size sheet of paper T are kept at the 2B positions I2B or are moved to the 2B positions I2B. At the paper-feeding areas, the first side core 76A and the pair of second side cores 76B are kept at the first positions I1 or are moved to the first positions I1.

More specifically, the storage table of the storage section 120 stores the following pieces of information for when an A4 portrait size sheet of paper T is fed to the fixing nip section F. These pieces of information are the information indicating that the side cores that are disposed in correspondence with the non-paper-feeding area of the A4 portrait size sheet of paper T are the fourth side cores 76D and the third side cores 76C, and the information regarding the movement amount of the driving portion 158 for moving the fourth side cores 76D and the third side cores 76C to the 2B positions I2B.

Therefore, as shown in FIG. 2C, the side core movement controlling section 111 controls the side core moving section 150 so that the fourth side cores 76D and the third side cores 76C that are disposed in correspondence with the non-paper-feeding area of the A4 portrait size sheet of paper T are moved to the 2B positions I2B of the second positions I2 where they do not overlap the first magnetic flux shielding members 78.

Therefore, at the non-paper-feeding area of the A4 portrait size sheet of paper T, the pair of first magnetic flux shielding members 78 reduces or blocks magnetic flux. At the paper-feeding area of the A4 portrait size sheet of paper T, the pair of first magnetic flux shielding members 78 does not reduce or block the magnetic flux generated by the induction coil 71.

When the printer 1 receives a print command for printing a sheet of paper T of maximum size whose length in the paper width direction D2 is the maximum paper-feeding width W1 (such as an A3 portrait size sheet of paper T), or when the printer 1 receives a print command for printing a sheet of paper T of minimum size whose length in the paper width direction D2 is the minimum paper-feeding width W2 (such as an A5 portrait size sheet of paper T), only the corresponding side cores 76 corresponding to the non-paper-feeding areas differ. That is, even in each of these cases, control that is the same as that when the printer 1 receives a print command for printing a sheet of paper T of intermediate size (whose length in the paper width direction D2 is the intermediate paper-feeding width W4 (such as, the A4 portrait size sheet of paper T)) is performed. Therefore, the descriptions of the control will be omitted. Even in the following description, when the paper-feeding areas (maximum paper-feeding area and minimum paper-feeding area) are set (formed), only the side cores 76 corresponding to the non-paper-feeding areas differ. That is, even in each of these cases, operational advantages that are the same as those when the sheet of paper T of intermediate size (such as, the A4 portrait size sheet of paper T) are fed to the fixing nip section F are provided. Therefore, the description of the sheet of paper T of intermediate size (such as, the A4 portrait size sheet of paper T) will be referred to, and the descriptions of the operational advantages provided when the sheets of paper T of other sizes are fed will not be given.

When the printer 1 receives a print command for printing a B4 portrait size sheet of paper T whose length in the paper width direction D2 is between the maximum paper-feeding width W1 and the intermediate paper-feeding width W4, the side core movement controlling section 111 controls the side core moving section 150 by referring to the storage section 120 on the basis of the size information of the sheets of paper T received by the receiving section 101 (that is, information regarding the lengths of the sheets of paper T in the paper width direction D2).

By this, as shown in FIG. 4B, the pair of fourth side cores 76D and the pair of third side cores 76C corresponding to the non-paper-feeding area of the B4 portrait size sheet of paper T are kept at the second positions I2 or are moved to the second positions I2. At the paper-feeding area, the first side core 76A and the second side cores 76B are kept at the first positions I1 or are moved to the first positions I1.

More specifically, the storage table of the storage section 120 stores the following pieces of information for when a B4 portrait size sheet of paper T whose length in the paper width direction D2 is between the maximum paper-feeding width W1 and the intermediate paper-feeding width W4 is to be fed. These pieces of information are the information indicating that the side cores that are disposed in correspondence with the non-paper-feeding area of the B4 portrait size sheet of paper T are the fourth side cores 76D, the information indicating that the boundaries between the paper-feeding area and the non-paper-feeding area correspond to portions that are situated partway in the third side cores 76C in the paper width direction D2, and the pieces of information regarding the movement amounts of the driving portion 158 for moving the fourth side cores 76D and the third side cores 76C to the 2B positions I2B.

Therefore, as shown in FIGS. 2B and 4B, the side core movement controlling section 111 controls the side core moving section 150 so that the pair of third side cores 76C is moved to the 2A positions I2A of the second positions I2 where the side cores 76 do not overlap parts of the pair of first magnetic flux shielding members 78. As shown in FIGS. 2C and 4C, the side core movement controlling section 111 controls the side core moving section 150 so that the fourth side cores 76D disposed outwardly of the third side cores 76C are moved to the 2B positions I2B of the second positions I2 where the side cores 76 do not overlap the pair of first magnetic flux shielding members 78.

Therefore, near the boundaries between the non-paper-feeding area and the paper-feeding area of the B4 portrait size sheet of paper T, the pair of first magnetic flux shielding members 78 reduces the magnetic flux.

In Step ST3, the printer 1 starts printing. More specifically, in the printer 1 according to the embodiment, a sheet of paper T that has been sent out from the pair of registration rollers 80 is transported to the transfer nip section N between the photosensitive drum 2 and the transfer roller 8 through the first transport path L1. When the sheet of paper T is transported toward the transfer nip section N in this way, first, the charging section 10 charges the entire surface of the photosensitive drum 2, and a laser light source (not shown) of the laser scanner unit 4 irradiates the photosensitive drum 2 with laser light, so that an electrostatic latent image corresponding to an image to be formed is formed on the surface of the photosensitive drum 2.

Next, the developing device 16 supplies charged toner to the photosensitive drum 2 by using the development roller 17. This causes the electrostatic latent image formed on the surface of the photosensitive drum 2 to be developed with the toner, so that a toner image is formed on the surface of the photosensitive drum 2. Subsequently, the transfer roller 8 transfers the toner image formed on the surface of the photosensitive dram 2 to the sheet of paper T that passes through the transfer nip section N.

Then, the sheet of paper T having the toner image transferred thereto passes through the second transport path L2, and is transported towards the fixing device 9. More specifically, the sheet of paper T on which the toner image is formed is transported towards the fixing nip section F formed by the heating rotating belt 93 and the pressing rotating member 9*b* of the fixing device 9.

In Step ST4, the heating rotating belt 93 is rotated. More specifically, when the fixing device 9 receives a predetermined control signal output from the printer controlling section (not shown), supply of electric power from the power supply section (not shown) to the drive controlling section (not shown) is started. When the supply of electric power to the drive controlling section is started, the rotation driving section (not shown) rotationally drives the pressing rotating member 9*b*. The heating rotating belt 93 is driven to rotate with the rotational driving of the pressing rotating member 9*b*. Then, the fixing-side roller 92 is driven to rotate with the rotation of the heating rotating belt 93. The temperature sensors 95 start to detect temperatures of a plurality of locations of the outer peripheral surface of the heating rotating belt 93.

In Step ST5, when the fixing device 9 receives a predetermined control signal output from the printer controlling section, generation of heat of the fixing device 9 is started at the same time as the supply of electric power to the driving controlling section starts. More specifically, when the printer controlling section receives, for example, image formation instruction information or a power-on signal of the printer 1, the fixing device 9 instructs the induction heating circuit section (not shown) to start generating heat. For example, on the basis of the temperatures of the outer peripheral surface of the heating rotating belt 93 detected by the temperature sensors 95, the fixing device 9 controls the induction heating circuit section.

This causes the induction heating circuit section to apply alternating current to the induction coil 71. The induction coil 71 to which the alternating current is applied is caused to generate magnetic fluxes for heating the heating rotating belt 93. Since the induction heating circuit section applies the alternating current having a predetermined frequency to the induction coil 71, the magnitude and the direction of the magnetic fluxes generated by the induction coil 71 change periodically.

Here, the heating rotating belt 93 and the magnetic member core section 72 (whose main constituents are ferromagnetic materials) form magnetic paths that extend in the circulation direction R3 so as to couple the inner side of the inner peripheral edge and the outer side of the outer peripheral edge of the induction coil 71. Therefore, the magnetic fluxes generated by the induction coil 71 pass through the magnetic paths formed by the heating rotating belt 93 and the magnetic member core section 72.

More specifically, for example, when an A4 portrait size sheet of paper T (having the intermediate paper-feeding width W4) is fed to the fixing nip section F, in the paper-feeding area, the first side core 76A and the pair of second side cores 76B are positioned at the first positions H. At the non-paper-feeding area, the pair of third side cores 76C and the pair of fourth side cores 76D are positioned at 2B positions I2B.

Therefore, as shown in FIG. 2A, when, at the paper-feeding areas of the sheets of paper T of respective sizes where the side cores 76 are positioned at the first positions I1, the alternating current applied by the induction heating circuit section (not shown) is positive, the magnetic fluxes generated by the induction coil 71 pass through the upper portion of the heating rotating belt 93 and are guided to the side cores 76. The magnetic fluxes pass through the side cores 76 and are guided to the arch core sections 74, and pass through the arch core sections 74 and are guided to the center core section 73. The magnetic fluxes that have passed through the center cores 73 are guided to the heating rotating belt 93.

Since the center core section 73 is formed with predetermined lengths that are long in the paper width direction D2, the magnetic fluxes that have passed through the arch core sections 74 so as to be separated from each other in the paper width direction D2 are guided to the heating rotating belt 93 after being dispersed or merged so as to be uniform in the paper width direction D2 in correspondence with the lengths of the center core section 73 by the magnetic paths formed by the center core section 73.

In contrast, when the alternating current applied by the induction heating circuit section is negative, for example, the magnetic fluxes generated by the induction coil 71 are in a direction opposite to that when the alternating current is positive, pass through the upper side of the heating rotating belt 93, the center cores 73, the arch core sections 74, and the side cores 76, and are guided to the heating rotating belt 93.

By changing the magnitude and direction of the magnetic fluxes that pass through the magnetic paths, eddy currents (induced currents) are generated by electromagnetic induction at the upper side of the heating rotating belt 93 in the vertical direction. When the eddy currents flow in the heating rotating belt 93, Joule heat is generated by electric resistance of the heating rotating belt 93. Accordingly, at the paper-feeding area of the sheet of paper T where the side cores 76 are positioned at the first positions I1, the heating rotating belt 93 generates heat by induction heating (IH) using electromagnetic induction.

Here, the center core section 73 and the arch core sections 74 are integrally formed. Therefore, in the disclosure, the degree of coupling of the magnetic field (magnetic flux) is higher than when the center core section 73 and the arch core sections 74 are separated from each other. Consequently, a reduction in the heating efficiency of the heating rotating belt 93 is suppressed. Since the reduction in the heating efficiency of the heating rotating belt 93 is suppressed, it is not necessary to make the diameters of the induction coil 71 large and to make the heating rotating member large, and an increase in the size of the fixing device 9 is not necessary either.

Further, when the side cores 76 are positioned between the arch core sections 74 and the first magnetic flux shielding members 78, the side cores 76 are positioned in contact with or close to the oblique end portions 744 of the arch core sections 74. This increases the degree of coupling of the magnetic field (magnetic flux) between the side cores 76 and the arch core sections 74. Therefore, compared to the case in which the side cores 76 and the arch core sections 74 are separated from each other, the heating efficiency of the heating rotating belt 93 is increased.

At the non-paper-feeding area, corresponding to the sheet of paper T of the corresponding size, of the heating rotating belt 93 where the side cores 76 are positioned at the 2B positions I2B, as shown in FIG. 2C, the pair of first magnetic flux shielding members 78 reduces or blocks the magnetic flux generated by the induction coil 71. More specifically, the magnetic fluxes generated by the induction coil 71 pass through the pair of first magnetic flux shielding members 78 between the arch core sections 74 and the heating rotating belt 93. Therefore, as shown in FIG. 2C, induced current is generated in the pair of first magnetic flux shielding members 78 when a vertical magnetic flux passes through the surfaces of the pair of first magnetic flux shielding members 78. By the induced current, the pair of first magnetic flux shielding members 78 generates a magnetic flux that is in a direction opposite to that of the vertical magnetic flux. By generating a magnetic flux that cancels interlinkage magnetic flux (vertical through magnetic flux), the pair of first magnetic flux shielding members 78 reduces or blocks the magnetic flux that is generated by the induction coil 71 and that passes through the magnetic paths. Therefore, the generation of heat of the heating rotating belt 93 is reduced or suppressed at the non-paper-feeding area where the side cores 76 are positioned at the 2B positions I2B.

When the side cores 76 are positioned at the 2B positions I2B, the pair of first magnetic flux shielding members 78 is separated from the arch core sections 74. Therefore, compared to the case in which the side cores 76 are positioned in contact with or close to the arch core sections 74, the degree of coupling of the magnetic field (magnetic flux) between the heating rotating belt 93 and each arch core section 74 is low. However, since the pair of first magnetic flux shielding members 78 is portions that reduce or block the magnetic flux, the degree of coupling of the magnetic field (magnetic flux) does not become a problem.

When the printer 1 performs fixing on, for example, a sheet of paper T (such as a B4 portrait size sheet of paper T) having a length in the paper width direction D2 that is between the maximum paper-feeding width W1 and the intermediate paper-feeding width W4, the side cores 76C are positioned at the 2A positions I2A so that they do not overlap approximately half of the pair of first magnetic flux shielding members 78. Therefore, as shown in FIG. 2B, the magnetic fluxes generated by the induction coil 71 are guided to the side cores 76, and pass through the first magnetic flux shielding members 78.

Therefore, when the side cores 76 are positioned at the 2A positions I2A where the side cores 76 do not overlap approximately half of the first magnetic flux shielding members 78 (see FIG. 2B), the temperature of the heating rotating belt 93 near the boundaries between the paper-feeding area and the non-paper-feeding area of the B4 portrait size sheet of paper T is lower than that when the side cores 76 overlap the entire pair of first magnetic flux shielding members 78 (see FIG. 2A), and higher than that when the side cores 76 do not overlap the entire pair of first magnetic flux shielding members 78 at all (see FIG. 2C). Therefore, corresponding to a B4 portrait size sheet of paper T, an excessive temperature increase of the heating rotating belt 93 at the non-paper-feeding area is reduced, and the heating rotating belt 93 is properly heated at the paper-feeding area.

In Step ST6, with the magnetic fluxes generated by the induction coil 71 being reduced or blocked at the non-paper-feeding area of each sheet of paper T of the corresponding size, the heating rotating belt 93 is heated to a predetermined fixing temperature at the fixing nip section F. More specifically, by rotating the heating rotating belt 93, a portion of the heating rotating belt 93 that generated heat by induction heating moves successively towards the fixing nip section F formed by the pressing rotating member 9*b* and the heating rotating member 9*a* (heating rotating belt 93) of the fixing device 9. The heat of the heating rotating belt 93 generated by induction heating is transmitted to the pressing rotating member 9*b* and the fixing-side roller 92 in contact with the heating rotating belt 93.

The fixing device 9 controls the induction heating circuit section (not shown) on the basis of the temperatures of the outer peripheral surface of the heating rotating belt 93 detected by the temperature sensors 95 so that the temperature of the fixing nip section F becomes the predetermined temperature. Accordingly, the fixing device 9 is heated so as to become the predetermined temperature at the fixing nip section F by the heating rotating belt 93 that is heated by induction heating.

Here, in the embodiment, by moving the side cores 76, the pair of first magnetic flux shielding members 78 adjusts the temperature of the heating rotating belt 93 so that the heating rotating belt 93 is not excessively heated at the non-paper-feeding area in accordance with the size of its corresponding sheet of paper T.

Therefore, an excessive temperature increase of the heating rotating member 9*a* at the non-paper-feeding area is suppressed in accordance with the size of the corresponding sheet of paper T.

In Step ST7, the sheet of paper T on which the toner image has been formed is moved into the fixing nip section F of the fixing device 9. At the fixing nip section F, toner is fused, to fix the toner to the sheet of paper T.

The printer 1 according to the embodiment provides, for example, the following advantages. The printer 1 according to the embodiment includes the heating rotating member 9*a* (heating rotating belt 93), the pressing rotating member 9*b*, the induction coil 71, and the magnetic member core section 72 that forms magnetic paths extending around the induction coil 71. The magnetic member core section 72 includes the pairs of arch core sections 74 (upper cores 75), the center core section 73 (upper core 75), the pair of first magnetic flux shielding members 78, and the side cores 76. The arch core sections 74 oppose the outer peripheral surface of the heating rotating belt 93. The center core section 73 is disposed beside the arch core sections 74 in the circulation direction of the magnetic paths. The pair of first magnetic flux shielding members 78 is disposed so as to be separated from the oblique end portions 744 of the arch core sections by a predetermined distance at sides of the oblique end portions 744 of the arch core sections 74 opposite to the center core section 73 and near the outer peripheral edge of the induction coil 71. The pair of first magnetic flux shielding members 78 includes first opposing surfaces 781 opposing the outer peripheral surface of the heating rotating belt 93. Each first opposing surface 781 is disposed apart from the outer peripheral surface of the heating rotating belt 93 by the separation distance K0. The side cores 76 are disposed at the sides of the pair of first magnetic flux shielding members 78 facing the oblique end portions 744 of the arch core sections 74, and include the second opposing surfaces 765 opposing the outer peripheral surface of the heating rotating belt 93. The side cores 76 are movable between the first positions I1 and the second positions I2. At the first positions I1, the second opposing surfaces 765 are separated from the outer peripheral surface of the heating rotating belt 93 by the first distance K1 that is equal to or less than the separation distance K0, so as to oppose the outer peripheral surface of the heating rotating belt 93. At the second positions I2, the second opposing surfaces 765 are separated from the outer peripheral surface of the heating rotating belt 93 by the second distance K2 that is greater than the separation distance K0, so as to oppose the outer peripheral surface of the heating rotating belt 93.

Because the printer 1 according to the embodiment has the above-described structure, as described above, an excessive temperature increase of the heating rotating belt 93 at an area that is situated outwardly of a paper-feeding area of a sheet of paper T is suppressed.

In the printer 1 of the embodiment, the pairs of side cores 76 are disposed side by side each other in the paper width direction D2. Therefore, because the pair of first magnetic flux shielding members 78 is disposed in correspondence with the pairs of side cores 76, by only moving the pair or pairs of side cores 76 to the second positions I2, the magnetic fluxes generated by the induction coil 71 are reduced or blocked by the pair of first magnetic flux shielding members 78. Therefore, by a simple structure, the excessive temperature increase of the heating rotating belt 93 at the area that is situated outwardly of a paper-feeding area of a sheet of paper T is suppressed.

In addition, since the side cores 76 are disposed in correspondence with the sheets of paper T of respective sizes, an excessive temperature increase of the heating rotating belt 93 at the area that is situated outwardly of the paper-feeding area corresponding to the sheet of paper T of the corresponding size is suppressed.

In the printer 1 according to the embodiment, when the side cores 76 are positioned between the arch core sections and the first magnetic flux shielding member 78, the side cores 76 are positioned in contact with or close to the oblique end portions 744 of the arch core sections 74. Therefore, the degree of coupling of the magnetic field (magnetic flux) between the side cores 76 and the arch core sections 74 is high. This increases heating efficiency of the heating rotating belt 93.

Further, the printer 1 according to some embodiments of the disclosure includes the image forming section GK that foil is an image on a sheet of paper T, the receiving section 101 that is capable of receiving image formation instruction information including size information regarding the size of a sheet of paper T on which the image is formed by the image forming section GK, and the side core movement controlling section 111 that controls the driving portion 158 so that a predetermined side core 76 among the side cores 76 moves to the first position 11 or the second position I2 on the basis of the size information of the sheet of paper T received by the receiving section 101. Therefore, the printer 1 according to the embodiment of the disclosure is capable of performing control so as to suppress an excessive temperature increase of an area outside a paper-feeding area of a sheet of paper T of the heating rotating belt 93 in accordance with the sheet of paper T of the corresponding size.

Next, another embodiment of the disclosure will be described. This embodiment will be primarily described by focusing on the differences between it and the previous embodiments. For structural components that are the same as those of the previous embodiments, the same reference numerals will be given, and detailed descriptions thereof will be omitted. For the points of this embodiment that are not particularly described, the descriptions of the previous embodiments may be applied and referred to when necessary.

Figure 6:
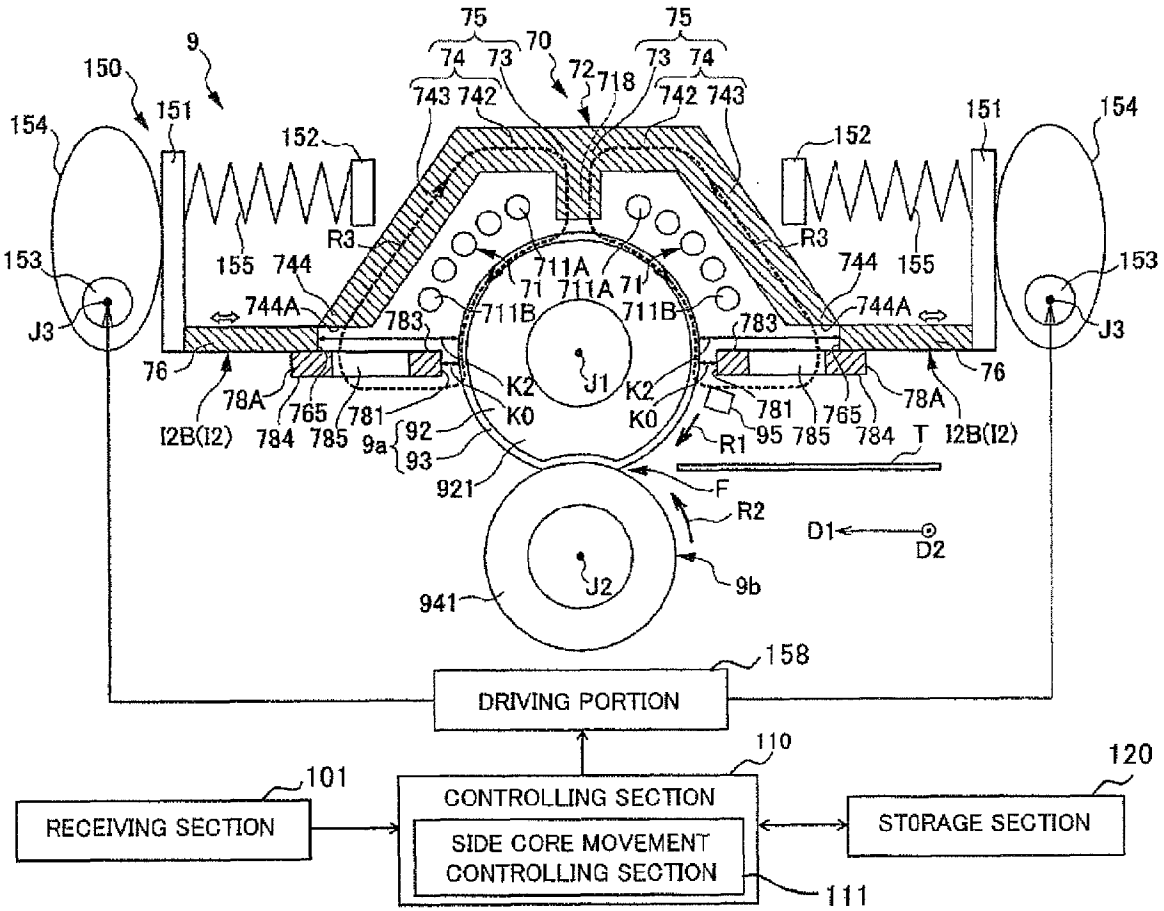
FIG. 6 is an exemplary sectional view for illustrating structural elements of a fixing device of a printer according to some embodiments, with a plurality of side cores being positioned at 2B positions.
Figure 7:
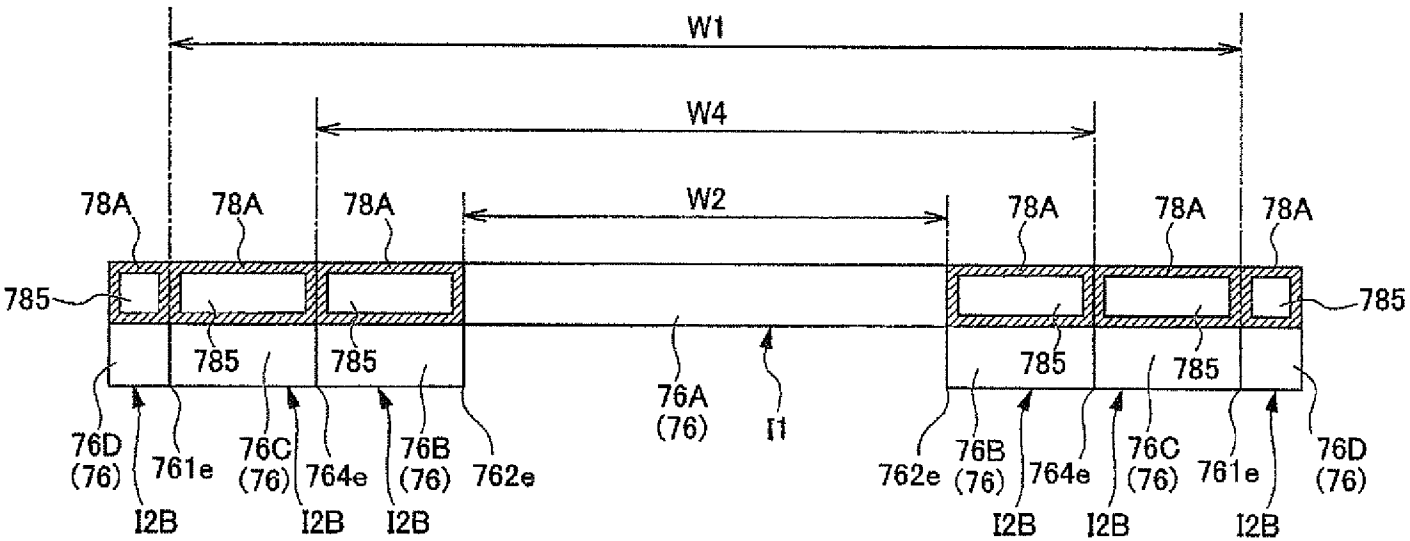
FIG. 7 shows positional relationships between the side cores and a plurality of second magnetic flux shielding members of the printer according to some embodiments from an upper side in a vertical direction, with the side cores being positioned at the 2B positions.

FIG. 6 is an exemplary sectional view for illustrating structural elements of a fixing device 9 of a printer 1 according to some embodiments, with side cores 76 being positioned at the 2B positions I2B. FIG. 7 shows exemplary positional relationships between the side cores 76 and second magnetic flux shielding members 78A of the printer 1 according to some embodiments from the upper side in the vertical direction, with the side cores 76 being positioned at the 2B positions I2B.

The fixing device 9 according to some embodiments differs from the fixing device 9 according to the previous embodiments in that the fixing device 9 according to this embodiment includes a pair of multiple second magnetic flux shielding members 78A as magnetic flux shielding members, and in that the pair of second magnetic flux shielding members 78A are annular.

As shown in FIGS. 6 and 7, each second magnetic flux shielding member 78A according to this embodiment includes a first surface 783, a second surface 784, and an opening 785. Each first surface 783 is disposed at a side of an oblique end portion 744 of a corresponding arch core section 74. Each second surface 784 is disposed at a side opposite to the corresponding first surface 783. Each opening 785 penetrates the second magnetic flux shielding member 78A from the corresponding first surface 783 to the corresponding second surface 784.

The pairs of second magnetic flux shielding members 78A are annular in correspondence with the pairs of side cores 76. The pairs of openings 785 are formed in correspondence with the pairs of side cores 76.

The edges of the openings 785 are formed by annular (loop-like) members. The pairs of openings 785 open in directions in which they extend through the first surfaces 783 and the second surfaces 784 below oblique end portions 744 of the pairs of arch core sections 74. Therefore, the pairs of openings 785 allow magnetic fluxes to pass therethrough in the vertical directions corresponding to the directions in which the pairs of openings 785 extend through the first surfaces 783 and the second surfaces 784. Like the first magnetic flux shielding members 78 according to the previous embodiments, the pairs of second magnetic flux shielding members 78A are formed of nonmagnetic materials having high electrical conductivity. As the materials of the pairs of second magnetic flux shielding members 78A, for example, oxygen-free copper may be used.

As shown in FIG. 6, when the side cores 76 are positioned at the 2B positions 12B, the second magnetic flux shielding members 78A block or reduce magnetic fluxes. More specifically, when the side cores 76 are positioned at the 2B positions I2B, induced current is generated in the second magnetic flux shielding members 78A corresponding to the side cores 76 along a circumferential direction at the annular (loop-like) members. The induced current is generated by passing vertical magnetic flux through the openings 785. Therefore, magnetic flux in a direction opposite to that of the magnetic flux that has passed through the openings 785 is generated in the second magnetic flux shielding members 78A by the induced current generated when the vertical magnetic flux passes through the openings 785. Then, by generating magnetic flux that cancels interlinkage magnetic flux (vertical through magnetic flux), each second magnetic flux shielding member 78A reduces or blocks magnetic flux that passes through a magnetic path.

The operation of the printer 1 according to this embodiment is similar to that of the printer 1 according to the previous embodiments. Therefore, for the operation of the printer 1 according to this embodiment, the description of the operation and actions of the printer 1 according to the previous embodiments may be referred to and omitted.

In addition to the indicated advantages of the previous embodiments, the printer 1 according to this embodiment provides the following advantages. In the printer 1 according to this embodiment, the pairs of second magnetic flux shielding members 78A are annular (loop-like). Therefore, while providing the advantages similar to those of the previous embodiments, the printer 1 according to this embodiment reduces costs of the materials of the magnetic flux shielding members.

Although preferred embodiments are described, the present disclosure may be carried out in various forms without being limited to the above-described embodiments.

For example, although, in the embodiments, the heating rotating member 9*a* includes the fixing-side roller 92 and the heating rotating belt 93 disposed so as to cover the fixing-side roller 92, the present invention is not limited thereto. For example, the heating rotating member 9*a* may include a heating-side roller, a fixing-side roller, and a heating rotating belt wound around the heating-side roller and the fixing-side roller.

Although, in the embodiments, the center core sections 73 are formed integrally with the arch core sections 74, the present invention is not limited thereto. For example, it is possible to form the center core section 73 separately from the arch core sections 74, and to dispose the center core section 73 and the arch core sections 74 in contact with or close to each other.

Although, according to some embodiments, the pair of first magnetic shielding members 78 is formed using one member, the present invention is not limited thereto. For example, two or more members may be used for first magnetic shielding members 78.

Although, according to some embodiments, the first magnetic flux shielding members 78 are disposed in areas including areas corresponding to the side cores 76, the present invention is not limited thereto. The first magnetic flux shielding members 78 only need to be disposed at areas where they can reduce or block the magnetic fluxes generated by the induction coil 71. For example, it is possible not to dispose the first magnetic flux members 78 at the areas corresponding to the side cores 76.

Although, in the embodiments, the side cores 76 of each pair disposed at the upstream side and the downstream side in the transportation direction D1 of the sheet of paper T are both moved, the present invention is not limited thereto. Only one of the side cores 76 of each pair may be moved.

Although, in the embodiments, the pairs of side cores 76 have the same lengths in the transportation direction D1 of the sheet of paper T so that each upstream-side side core 76 and its corresponding downstream-side side core 76 in the transportation direction D1 of the sheet of paper T form a pair, the present invention is not limited thereto. The pairs of side cores 76 may be such that the side cores 76 of each pair have different lengths in the transportation direction D1 of the sheet of paper T.

Although, in the second embodiment, there are a plurality of second magnetic flux shielding members 78A, the present invention is not limited thereto. The second magnetic flux shielding member 78A may be one part.

Although, in the embodiments, the sizes of the sheets of paper T are, for example, an A3 portrait size and an A5 portrait size, the present invention is not limited thereto. The sizes of the sheets of paper T may be in inches.

The type of image forming apparatus according to the disclosure is not particularly limited. In addition to being a printer, the image forming apparatus may be copying apparatuses, facsimiles, or multi-functional peripherals of these apparatuses. The sheet-like transfer material is not limited to a sheet of paper. It may be a film sheet.

Having thus described in detail embodiments of the present invention, it is to be understood that the invention disclosed by the foregoing paragraphs is not to be limited to particular details and/or embodiments set forth in the above description, as many apparent variations thereof are possible without departing from the spirit or scope of the present invention.

What is claimed is:

1. A fixing device comprising:

a heating rotating member configured to generate heat by induction heating;

a pressing rotating member that is disposed so as to oppose the heating rotating member;

a fixing nip section that is formed by the heating rotating member and the pressing rotating member, the fixing nip section nipping and transporting a transfer material;

an induction coil disposed apart from and along an outer surface of the heating rotating member, the induction coil being operable for generating magnetic flux for causing the heating rotating member to generate the heat; and a magnetic member core section forming a magnetic path extending along an inner side of an inner peripheral edge of the induction coil and an outer side of an outer peripheral edge of the induction coil, the magnetic path surrounding the induction coil, wherein the magnetic member core section includes a first core section, a second core section, a magnetic flux shielding member, and a plurality of third core sections, the first core section opposing the outer surface of the heating rotating member with the induction coil being disposed therebetween, the second core section being disposed beside the first core section and near the inner peripheral edge of the induction coil in a direction in which the magnetic path surrounds the induction coil, the second core section opposing the outer surface of the heating rotating member without the induction coil being disposed therebetween, the magnetic flux shielding member being disposed at a side of an end portion of the first core section opposite to the second core section and separated from the end portion near the outer peripheral edge of the induction coil, the magnetic flux shielding member opposing the outer surface of the heating rotating member without the induction coil being disposed therebetween, the magnetic flux shielding member reducing or blocking the magnetic flux, the plurality of third core sections being disposed at a side of the magnetic flux shielding member facing the end portion of the first core section, the plurality of third core sections opposing the outer surface of the heating rotating member without the induction coil being disposed therebetween, and wherein at least one of the third core sections is movable to a first position and to a second position, the first position being where an end portion of the at least one of the third core sections that faces the heating rotating member is separated from the outer surface of the heating rotating member by a first distance and opposes the outer surface of the heating rotating member, the second position being where the end portion of the at least one of the third core sections that faces the heating rotating member is separated from the outer surface of the heating rotating member by a second distance and opposes the outer surface of the heating rotating member, the second distance being greater than the first distance.

2. The fixing device according to claim 1, wherein the plurality of third core sections are disposed side by side in a direction vertical to a transportation direction of the transfer material.

3. The fixing device according to claim 2, wherein, when the plurality of third core sections are positioned between the first core section and the magnetic flux shielding member, the plurality of third core sections are positioned in contact with or close to the end portion of the first core section.

4. The fixing device according to claim 2, wherein a plurality of the magnetic flux shielding members corresponding to the plurality of third core sections are provided so as to be annular in correspondence with the plurality of third core sections, and wherein each magnetic flux shielding member has a first surface, a second surface, and an opening, the first surface being a surface facing the end portion of the first core section, the second surface being a surface opposite to the first surface, the opening extending through the first surface and the second surface.

5. The fixing device according to claim 1, wherein the plurality of third core sections are each positioned at the first position or the second position in accordance with a size of the transfer material.

6. The fixing device according to claim 1, wherein an end portion of the magnetic flux shielding member facing the heating rotating member is disposed so as to be separated from the outer surface of the heating rotating member by a separation distance, wherein the first distance is less than or equal to the separation distance, and wherein the second distance is greater than the separation distance.

7. The fixing device according to claim 1, wherein the second position includes a 2A position and a 2B position, the 2A position being where part of the magnetic flux shielding member does not overlap the third core sections, the 2B position being where the magnetic flux shielding member does not overlap the third core sections.

8. The fixing device according to claim 2, wherein the plurality of third core sections are each disposed at a position corresponding to a size of the transfer material along a direction vertical to the transportation direction of the transfer material.

9. The fixing device according to claim 8, wherein the plurality of third core sections are each positioned at the first position or the second position in accordance with the size of the transfer material that is transported to the fixing nip section.

10. An image forming apparatus comprising:

an image forming section configured to form a toner image on a transfer material; and a feed/discharge section configured to supply the transfer material to the image forming section and configured to discharge the transfer material on which the toner image is formed, wherein the image forming section includes an image carrying member where an electrostatic latent image is formed, a developing device configured to develop the electrostatic latent image to form the toner image, a transfer device configured to transfer the toner image to the transfer material, and a fixing device configured to fix the toner image transferred to the transfer material to the transfer material, and wherein the fixing device includes a heating rotating member configured to generate heat by induction heating;

a pressing rotating member that is disposed so as to oppose the heating rotating member;

a fixing nip section that is formed by the heating rotating member and the pressing rotating member, the fixing nip section nipping and transporting a transfer material;

an induction coil disposed apart from and along an outer surface of the heating rotating member, the induction coil being operable for generating magnetic flux for causing the heating rotating member to generate the heat; and a magnetic member core section forming a magnetic path extending along an inner side of an inner peripheral edge of the induction coil and an outer side of an outer peripheral edge of the induction coil, the magnetic path surrounding the induction coil, wherein the magnetic member core section includes a first core section, a second core section, a magnetic flux shielding member, and a plurality of third core sections, the first core section opposing the outer surface of the heating rotating member with the induction coil being disposed therebetween, the second core section being disposed beside the first core section and near the inner peripheral edge of the induction coil in a direction in which the magnetic path surrounds the induction coil, the second core section opposing the outer surface of the heating rotating member without the induction coil being disposed therebetween, the magnetic flux shielding member being disposed at a side of an end portion of the first core section opposite to the second core section and separated from the end portion near the outer peripheral edge of the induction coil, the magnetic flux shielding member opposing the outer surface of the heating rotating member without the induction coil being disposed therebetween, the magnetic flux shielding member reducing or blocking the magnetic flux, the plurality of third core sections being disposed at a side of the magnetic flux shielding member facing the end portion of the first core section, the plurality of third core sections opposing the outer surface of the heating rotating member without the induction coil being disposed therebetween, and wherein at least one of the third core sections is movable to a first position and to a second position, the first position being where an end portion of the at least one of the third core sections that faces the heating rotating member is separated from the outer surface of the heating rotating member by a first distance and opposes the outer surface of the heating rotating member, the second position being where the end portion of the at least one of the third core sections that faces the heating rotating member is separated from the outer surface of the heating rotating member by a second distance and opposes the outer surface of the heating rotating member, the second distance being greater than the first distance.

11. The image forming apparatus according to claim 10, further comprising a receiving section and a drive controlling section, the receiving section receiving image formation instruction information including size information of the transfer material having the toner image formed thereon by the image forming section, the drive controlling section moving the third core sections to the first position and to the second position.

12. The image forming apparatus according to claim 10, wherein the plurality of third core sections are disposed side by side in a direction vertical to a transportation direction of the transfer material.

13. The fixing device according to claim 12, wherein a plurality of the magnetic flux shielding members corresponding to the plurality of third core sections are provided so as to be annular in correspondence with the plurality of third core sections, and wherein each magnetic flux shielding member has a first surface, a second surface, and an opening, the first surface being a surface facing the end portion of the first core section, the second surface being a surface opposite to the first surface, the opening extending through the first surface and the second surface.

14. The image forming apparatus according to claim 10, wherein the plurality of third core sections are each positioned at the first position or the second position in accordance with a size of the transfer material.

15. The image forming apparatus according to claim 10, wherein an end portion of the magnetic flux shielding member facing the heating rotating member is disposed so as to be separated from the outer surface of the heating rotating member by a separation distance, wherein the first distance is less than or equal to the separation distance, and wherein the second distance is greater than the separation distance.

16. The image forming apparatus according to claim 10, wherein the second position includes a 2A position and a 2B position, the 2A position being where part of the magnetic flux shielding member does not overlap the third core sections, the 2B position being where the magnetic flux shielding member does not overlap the third core sections.

17. The image forming apparatus according to claim 12, wherein the plurality of third core sections are each disposed at a position corresponding to a size of the transfer material along a direction vertical to the transportation direction of the transfer material.

18. The image forming apparatus according to claim 17, wherein the plurality of third core sections are each positioned at the first position or the second position in accordance with the size of the transfer material that is transported to the fixing nip section.

* * * * *